US009922793B2

(12) United States Patent
Hori et al.

(10) Patent No.: US 9,922,793 B2
(45) **Date of Patent: *Mar. 20, 2018**

(54) IMAGE CAPTURE DEVICE

(71) Applicant: NANOX IMAGING PLC, Gibraltar (GI)

(72) Inventors: Tetsuo Hori, Yokohama (JP); Hitoshi Masuya, Kashiwa (JP); Hidenori Kenmotsu, Machida (JP)

( * ) Notice: Subject to any disclaimer, the term of this patent is extended or adjusted under 35 U.S.C. 154(b) by 250 days.

This patent is subject to a terminal disclaimer.

(21) Appl. No.: 14/421,831

(22) PCT Filed: Aug. 11, 2013

(86) PCT No.: PCT/IB2013/056563

§ 371 (c)(1),
(2) Date: Feb. 15, 2015

(87) PCT Pub. No.: WO2014/027294

PCT Pub. Date: Feb. 20, 2014

(65) Prior Publication Data

US 2015/0206698 A1 Jul. 23, 2015

Related U.S. Application Data

(60) Provisional application No. 61/683,743, filed on Aug. 16, 2012, provisional application No. 61/729,715, filed on Nov. 26, 2012.

(51) Int. Cl.
*H01J 35/00* (2006.01)
*H01J 29/62* (2006.01)
(Continued)

(52) U.S. Cl.
CPC ..... *H01J 29/62* (2013.01); *H01J 29/025* (2013.01); *H01J 29/46* (2013.01); *H01J 31/28* (2013.01); *H01J 35/065* (2013.01)

(58) Field of Classification Search
CPC ..... H01J 29/62; H01J 29/025; H01J 35/065; H01J 29/46; H01J 31/28; H01J 2235/068
(Continued)

(56) References Cited

U.S. PATENT DOCUMENTS 5,587,623 A 12/1996 Jones
5,635,789 A 6/1997 Makishima et al.
(Continued)

FOREIGN PATENT DOCUMENTS

CN 102324350 1/2012
CN 202126987 1/2012
(Continued)

OTHER PUBLICATIONS

Evtukh A.A. et al, "Emission Properties of the Silicon Nanocomposite Structures", Dec. 31, 1999, Functional Materials 6, No. 3.

(Continued)

*Primary Examiner* — Courtney Thomas
(74) *Attorney, Agent, or Firm* — Alphapatent Associates, Ltd; Daniel J. Swirsky

(57) ABSTRACT

An image capture device and an x-ray emitting device are introduced comprising an electron receiving construct and an electron emitting construct separated by a spacer. The electron receiving construct comprises a faceplate, an anode and an inward facing photoconductor. The electron emitting construct comprises: a backplate; a substrate; a cathode; a plurality of field emission type electron sources arranged in an array; a stratified resistive layer between the field emission type electron source and the cathode; a gate electrode; a focus structure and a gate electrode support structure configured to support the gate electrode at a required cathode-gate spacing from the cathode.

20 Claims, 33 Drawing Sheets

(51) Int. Cl.

| | |
|---|---|
| ***H01J 29/46*** | (2006.01) |
| ***H01J 31/28*** | (2006.01) |
| ***H01J 29/02*** | (2006.01) |
| ***H01J 35/06*** | (2006.01) |

(58) Field of Classification Search
USPC ..... 378/119–122
See application file for complete search history.

(56) References Cited

U.S. PATENT DOCUMENTS

| | | | |
|---|---|---|---|
| 5,677,539 | A | 10/1997 | Apotovsky et al. |
| 5,892,321 | A | 4/1999 | Itoh et al. |
| 5,905,264 | A | 5/1999 | Shahar et al. |
| 5,929,557 | A | 7/1999 | Makishima et al. |
| 6,013,986 | A | 1/2000 | Knall et al. |
| 6,028,313 | A | 2/2000 | McDaniel |
| 6,031,250 | A | 2/2000 | Brandes et al. |
| 6,034,373 | A | 3/2000 | Shahar et al. |
| 6,259,765 | B1 | 7/2001 | Baptist |
| 6,333,968 | B1 | 12/2001 | Whitlock et al. |
| 6,456,691 | B2 | 9/2002 | Takahashi et al. |
| 6,553,096 | B1 | 4/2003 | Zhou et al. |
| 6,674,837 | B1 | 1/2004 | Taskar et al. |
| 6,760,407 | B2 | 7/2004 | Price et al. |
| 6,911,767 | B2 | 6/2005 | Takai |
| 7,082,182 | B2 | 7/2006 | Zhou |
| 7,085,351 | B2 | 8/2006 | Lu et al. |
| 7,085,352 | B2 | 8/2006 | Dunham |
| 7,158,102 | B2 | 1/2007 | Hansen et al. |
| 7,192,031 | B2 | 3/2007 | Dunham et al. |
| 7,227,924 | B2 | 6/2007 | Zhou et al. |
| 7,323,692 | B2 | 1/2008 | Rowlands |
| 7,348,531 | B2 | 3/2008 | Okuda et al. |
| 7,627,087 | B2 | 12/2009 | Zou et al. |
| 7,723,664 | B2 | 5/2010 | Honda et al. |
| 7,781,738 | B2 | 8/2010 | Nam et al. |
| 7,801,277 | B2 | 9/2010 | Zou et al. |
| 7,809,114 | B2 | 10/2010 | Zou et al. |
| 7,826,594 | B2 | 11/2010 | Zou et al. |
| 7,826,595 | B2 | 11/2010 | Liu et al. |
| 7,834,308 | B2 | 11/2010 | Namba et al. |
| 7,868,850 | B2 | 1/2011 | Jin et al. |
| 7,873,146 | B2 | 1/2011 | Okunuki et al. |
| 7,991,114 | B2 | 8/2011 | Okunuki et al. |
| 7,991,120 | B2 | 8/2011 | Okunuki et al. |
| 8,044,596 | B2 | 10/2011 | Taniguchi et al. |
| 8,155,273 | B2 | 4/2012 | Eaton et al. |
| 8,203,112 | B2 | 6/2012 | Okuda et al. |
| 8,270,567 | B2 | 9/2012 | Yamamoto et al. |
| 8,428,221 | B2 | 4/2013 | Boese et al. |
| 8,447,013 | B2 | 5/2013 | Sprenger et al. |
| 8,488,737 | B2 | 7/2013 | Boese et al. |
| 8,588,372 | B2 | 11/2013 | Zou et al. |
| 8,755,493 | B2 | 6/2014 | Travish et al. |
| 8,861,686 | B2 | 10/2014 | Kim |
| 8,953,747 | B2 | 2/2015 | de Looz et al. |
| 8,989,351 | B2 | 3/2015 | Vogtmeier et al. |
| 2003/0044519 | A1 | 3/2003 | Takai |
| 2003/0201954 | A1 | 10/2003 | Hansen et al. |
| 2007/0235772 | A1 | 10/2007 | Jin et al. |
| 2007/0246789 | A1 | 10/2007 | Freudenberger et al. |
| 2008/0043920 | A1 | 2/2008 | Liu |
| 2008/0135766 | A1 | 6/2008 | Nam et al. |
| 2008/0211401 | A1 | 9/2008 | Nakada et al. |
| 2009/0096393 | A1 | 4/2009 | Taniguchi |
| 2009/0185660 | A1 | 7/2009 | Zou et al. |
| 2010/0025568 | A1 | 2/2010 | Okuda et al. |
| 2010/0128845 | A1 | 5/2010 | Yamamoto |
| 2010/0290593 | A1 | 11/2010 | Legagneux et al. |
| 2011/0305314 | A1 | 12/2011 | Kitamura et al. |
| 2015/0092923 | A1* | 4/2015 | Iida ..... G01N 23/046 378/138 |
| 2015/0206698 | A1* | 7/2015 | Hori ..... H01J 29/46 378/62 |

FOREIGN PATENT DOCUMENTS

| | | | |
|---|---|---|---|
| GB | 1467487 | A | 3/1977 |
| JP | H07-29507 | A | 1/1995 |
| JP | H-10 302688 | A | 11/1998 |
| JP | 2000-48743 | A | 2/2000 |
| JP | 2007194014 | A | 8/2007 |
| JP | 2007 305337 | A | 11/2007 |
| JP | 2009-272289 | | 11/2009 |
| JP | 2009-272289 | A | 11/2009 |
| JP | 2011 071022 | A | 4/2011 |
| JP | 4693884 | B2 | 6/2011 |
| JP | 5041875 | B2 | 10/2012 |
| JP | 5066392 | B2 | 11/2012 |
| JP | 5294653 | B2 | 9/2013 |
| WO | 1997023002 | | 6/1997 |
| WO | 2008136188 | A1 | 11/2008 |
| WO | 2013149004 | A1 | 10/2013 |

OTHER PUBLICATIONS

Toshinobu Miyoshi et al., Development of an X-ray HARP-FEA Detector System for High-throughput Protein Crystallography, Journal of Synchrotron Radiation (2008) 15, 281-284.

* cited by examiner

IMAGE CAPTURE DEVICE

CROSS-REFERENCE TO RELATED APPLICATIONS

This application is a U.S. National Phase Application under 35 U.S.C. 371 of International Application No. PCT/IB2013/056563, which has an international filing date of Aug. 11, 2013, and which claims priority and benefit from U.S. Provisional Patent Application No. 61/683,743, filed Aug. 16, 2012, and U.S. Provisional Patent Application No. 61/729,715, filed Nov. 26, 2012, the contents and disclosure of which are incorporated herein by reference in their entirety.

FIELD OF THE INVENTION

The embodiments disclosed herein relate to a field emission type electron source and devices comprising the same, in particular, an image capture device and an x-ray emitting device, as well as an imaging system having said image capture device and said x-ray emitting device.

BACKGROUND

There is a gaining enthusiasm for smaller and thinner (flat) imaging devices based on replacing hot cathode ray tube electron sources used in video tubes and X-ray imaging devices with field emission type electron sources. Examples of image capture devices using field emission type electron sources are visible light image capture devices as shown in, e.g., Japanese laid open publication JP 2000-48743A (the '743 publication) and X-ray image capture devices as shown in, e.g., Japanese laid open publication 2009-272289 (the '289 publication).

Video tubes using hot cathode electron sources, such as those shown in, e.g., Japanese laid-open publication JP H07-29507A (the '507 publication) as well as the above-mentioned prior art imaging devices comprising field emission type electron sources have typically made use of a grid electrode, e.g., a thin material with an array of small openings and having a grid-, mesh- or sieve-like structure, positioned between the anode and cathode. This grid electrode may also be referred to as a control grid or a trimming electrode. The grid electrode is typically for accelerating electrons from a hot cathode or a field emission type electron source and project the electron beam. The grid electrode may also improve the aim of electron beams by only allowing the passage of electron beams traveling orthogonally from the electron source and blocking electron beams having an angular component.

Reference is now made to FIG. 1, which shows a conventional, PRIOR ART image capture device with a field emission type electron source 15 and a grid electrode 20', as shown in the '743 publication. The grid electrode 20', positioned between the electron emitting construct (comprising the field emission type electron source 15) and the electron receiving construct (comprising the faceplate 3), accelerates and directs the electron beams from the field emission type electron sources 15 to a predetermined target area on the electron receiving construct.

Imaging devices comprising a grid electrode have the disadvantage of having a reduced utilization efficiency of the electron beams being emitted from the electron source. For example, when a grid electrode, e.g., as illustrated in the '507 publication, is used, electrons that fail to pass through the open area are absorbed into the grid and are lost without providing signal current. On the other hand, if the size of the grid electrode openings is widened (to increase utilization efficiency of the electron beams), another problem arises wherein electrons with an angular (i.e., non-perpendicular) component will pass through and hit the photoconductor outside of the predetermined target location. As such, electron beams may hit an adjacent pixel causing a readout in a pixel that is different from the target pixel, thus reducing image quality (e.g., resolution). In addition, the physical strength of the grid electrode become weaker as the aperture of the grid openings becomes wider. Therefore, it is difficult to assemble and maintain a grid with a large aperture. For at least these reasons, the ability to mitigate the reduced utilization efficiency of the electron beam caused by the grid electrode, by modifying the grid electrode, is limited.

Further, the grid electrode can become a source of microphonic noise in applications where the system must be moved during irradiation such as video imaging, CT scanning or Fluoroscopy. The interaction between the electron beam and the grid can create an energy spread in the electron beam, thus changing the system characteristics.

Finally, the presence of a grid electrode presents an assembly problem regardless of the grid opening aperture. This assembly problem is exacerbated in a large, thin imaging device such as a flat panel-type image capture device, in which the grid electrode must be assembled within a narrow gap in a precise manner, leading to increased defective products and increased cost of production.

The disclosure below addresses the above-described problems associated with conventional imaging devices using field emission type electron sources.

SUMMARY OF THE INVENTION

In a first aspect of the disclosure, the embodiments described herein provide an image capture device comprising an electron receiving construct and an electron emitting construct separated by at least one spacer situated such that an inner gap is present between said electron receiving construct and said electron emitting construct. The electron receiving construct may comprise a faceplate, an anode and an inward facing photoconductor. The electron emission construct may comprise: (a) a backplate, (b) a substrate, (c) a cathode, (d) a plurality of field emission type electron sources arranged in an array, wherein said field emission type electron source is configured to emit an electron beam towards said photoconductor and (e) a gate electrode. The inner gap may provide an unobstructed space between the electron emitting construct and the electron receiving construct. In certain embodiments of the disclosure, the image capture device does not comprise a grid electrode.

In certain embodiments of the disclosure, the electron emitting construct further comprises a plurality of first focus structures arranged in an array, each of said first focus structures comprising a first focus electrode.

In certain embodiments of the disclosure, the first focus structure surrounds a unit cell comprising a subset of said field emission type electron sources, said unit cell defining a pixel.

In certain embodiments of the disclosure, the electron emitting construct comprises an array of second focus structures comprising a second focus electrode.

In certain embodiments of the disclosure, the photoconductor comprises amorphous Selenium.

In certain embodiments of the disclosure, the field emission type electron source is a Spindt-type electron source.

In certain embodiments of the disclosure, the image capture devices further comprises a resistive layer situated between the field emission type electron source and the cathode.

In certain embodiments of the disclosure, the field emission type electron source is electrically connected to a driving circuit via a signal line, and wherein the first focus electrode surrounds said signal line.

In certain embodiments of the disclosure, the substrate is silicon-based.

In certain embodiments of the disclosure, at least one member selected from the group consisting of the cathode, the resistive layer, the signal line, the field emission type electron source, the first focus structure, the first focus electrode, the second focus structure, the second focus electrode and any combination thereof, is integral to the substrate.

In a second aspect of the disclosure, the embodiments described herein provide an x-ray emitting device comprising an electron receiving construct and an electron emitting construct separated by at least one spacer situated such that an inner gap is present between said electron receiving construct and said electron emitting construct; said electron receiving construct comprising an anode, the anode being an x-ray target; and said electron emitting construct comprising: a backplate; a substrate; a cathode; a plurality of field emission type electron sources arranged in an array, wherein said field emission type electron source is configured to emit an electron beam towards said anode; and a gate electrode; wherein said inner gap provides an unobstructed space between said electron emitting construct and said electron receiving construct.

In certain embodiments of the disclosure, the anode comprises one or more of the group consisting of molybdenum, rhodium and tungsten.

In certain embodiments of the disclosure, the x-ray emitting device does not comprise a grid electrode.

In certain embodiments of the disclosure, the electron emitting construct of the image capture device or x-ray emitting device further comprises a plurality of first focus structures arranged in an array, each of said first focus structures comprising a first focus electrode.

In certain embodiments of the disclosure, the first focus structure surrounds a unit cell comprising a subset of said field emission type electron sources, said unit cell defining an emitter area.

In certain embodiments of the disclosure, the electron emitting construct comprises an array of second focus structures comprising a second focus electrode.

In certain embodiments of the disclosure, the field emission type electron source is a Spindt-type electron source.

In certain embodiments of the disclosure, the substrate is silicon-based.

In certain embodiments of the disclosure at least one member selected from the group consisting of the cathode, the signal line, the field emission type electron source, the first focus structure, the first focus electrode, the second focus structure, the second focus electrode and any combination thereof, is integral to the substrate.

In certain embodiments of the disclosure, the electron receiving construct further comprises a collimator.

In a second aspect of the disclosure, the embodiments described herein provide an x-ray imaging system comprising the image capture device such as described herein and the x-ray emitting device of such as described herein, the image capture device and the x-ray emitting device facing each other, the x-ray emitting device being configured to emit x-rays towards the photoconductor of the image capture device.

In certain embodiments of the disclosure, the x-rays are parallel rays.

In certain embodiments of the disclosure, the emission of x-rays is restricted to a projection module defining a subset of the x-ray emitting device.

In certain embodiments of the disclosure, a portion of the image capture device defined by a capture module is activated to enable x-ray detection, the capture module being characterized by the area of the image capture device expected to receive the non-scattered x-rays emitted from the x-ray emitting device.

In certain embodiments of the disclosure, a portion of the image capture device not expected to receive the non-scattered x-rays emitted from the x-ray emitting device is inactivated.

In certain embodiments of the disclosure, a plurality of projection modules are activated serially to emit x-rays over an area larger than the area of one projection module.

In certain embodiments of the disclosure, the system is a tomographic imaging system, wherein a plurality of projection modules are activated serially to emit x-rays towards an area of interest at said plurality of angles.

According to another aspect of the disclosure an image capture device and an x-ray emitting device are introduced comprising an electron receiving construct and an electron emitting construct separated by at least one spacer situated such that an inner gap is present between the electron receiving construct and the electron emitting construct, the inner gap providing an unobstructed space between the electron emitting construct and the electron receiving construct, wherein: the electron receiving construct comprises a faceplate, an anode and an inward facing photoconductor; and the electron emitting construct comprises: a backplate; a substrate; a cathode; a plurality of field emission type electron sources configured to emit an electron beam towards the photoconductor the field emission type electron sources being arranged in an array having a regular electron source spacing; a stratified resistive layer situated between the field emission type electron source and the cathode; a gate electrode; and at least one gate electrode support structure configured to support the gate electrode at a required cathode-gate spacing from the cathode.

In some embodiments, the stratified resistive layer of the image capture device or x-ray emitting device may comprise at least a proximal resistor stratum closest to the field emission type electron sources, and a distal resistor stratum further from the field emission type electron sources, the proximal resistor stratum comprising a first resistive material having a first characteristic resistivity and the distal resistor stratum comprising a second resistive material having a second characteristic resistivity, wherein the first characteristic resistivity is greater than the second characteristic resistivity. Optionally, the stratified resistive layer may further comprise at least one intermediate resistor stratum between the proximal resistor stratum and the distal resistor stratum, the at least one intermediate resistor stratum comprising at least a third resistive material having a characteristic resistivity intermediate between the first characteristic resistivity and the second characteristic resistivity. For example, the proximal resistor stratum may comprise silicon oxygen carbonitride (SiOCN) or the like, the distal resistor stratum may variously comprise silicon, a silicon carbide wafer, or the like, and the intermediate resistor stratum comprises an amorphous silicon carbonitride film or the like. Alternatively, or additionally, other resistive materials may be selected having equivalent relative resistances.

Furthermore, the stratified resistive layer may comprise at least one resistive stratum comprising a resistive material, and a first barrier stratum interposed between the resistive material and the cathode. Additionally or alternatively, the stratified resistive layer may comprise at least one resistive stratum comprising a resistive material, and a second barrier stratum interposed between the resistive material and the field emission type electron sources. Optionally, the first barrier stratum may comprise a material selected from an unreactive material selected from the group consisting of: carbon rich siliconcarbide, nitrogen rich silicon carbonitride, amorphous carbon and the like as well as combinations thereof. For example, carbon rich siliconcarbide (SixCy) may be selected in which y is greater than x. Additionally or alternatively, carbon rich siliconcarbonitride (SixCyNz) may be selected in which z is greater than y. Optionally, again, the second barrier stratum may comprise a material selected from a unreactive material selected from the group consisting of carbon rich siliconcarbide, nitrogen rich silicon carbonitride, amorphous carbon and the like as well as combinations thereof.

In certain embodiments of the electron emitting construct, the gate electrode support structure of the image capture device or x-ray emitting device may be configured such that a surface path between the cathode and the gate electrode is greater than the cathode-gate spacing. Accordingly, the gate electrode support structure may comprise a stratified interlayer. Optionally, the stratified interlayer may comprise at least one stratum of a first material and at least a one stratum of a second material wherein the first material is more readily etched than the second material. Where appropriate, the stratified interlayer may comprise at least one stratum of a low density material and at least a one stratum of a high density material. For example the stratified interlayer may comprise at least one stratum of silicon dioxide.

Where appropriate the stratified interlayer may comprise at least one stratum of high density silicon dioxide and at least one stratum of low density silicon dioxide. Accordingly, the stratified interlayer may comprise at least one stratum of silicon dioxide and at least one stratum of silicon oxynitride.

Additionally or alternatively, the gate electrode support structure may comprise a plurality of support columns. Optionally, the support columns may be arranged in an array having a regular inter-column spacing. Accordingly, the inter-column spacing may be greater than the electron source spacing. Accordingly, the column spacing between support columns may be greater than the source-spacing between the electron sources. Where appropriate, the gate electrode support columns may be configured such that the column-source spacing between at least one support column and at least one neighboring electron sources is greater than the source-spacing between the electron sources.

BRIEF DESCRIPTION OF THE FIGURES

For a better understanding of the embodiments and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments only, and are presented in the cause of providing what is believed to be the most useful and readily understood description of the principles and conceptual aspects. In this regard, no attempt is made to show structural details in more detail than is necessary for a fundamental understanding; the description taken with the drawings making apparent to those skilled in the art how the several selected embodiments may be put into practice. In the accompanying drawings.

DETAILED DESCRIPTION OF THE INVENTION

Figure 1:
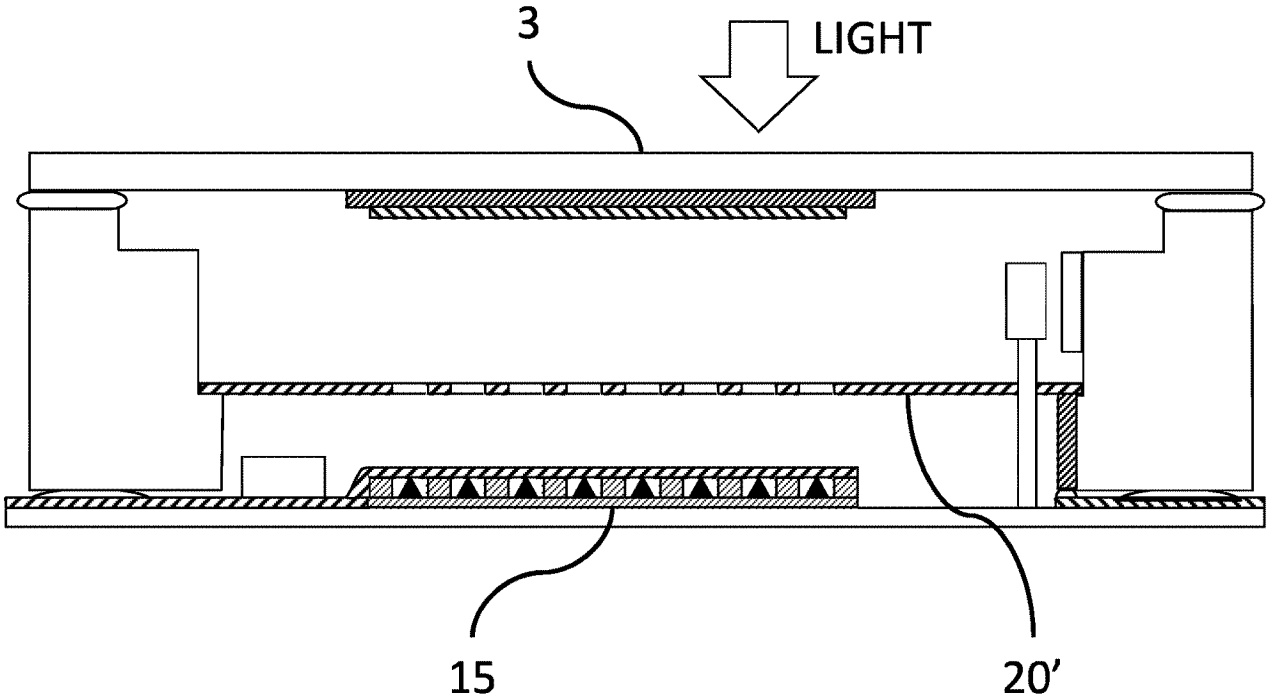
Figure 1 PRIOR ART
FIG. 1 is a schematic diagram representing a PRIOR ART image capture device comprising a grid electrode.
Figure 2:
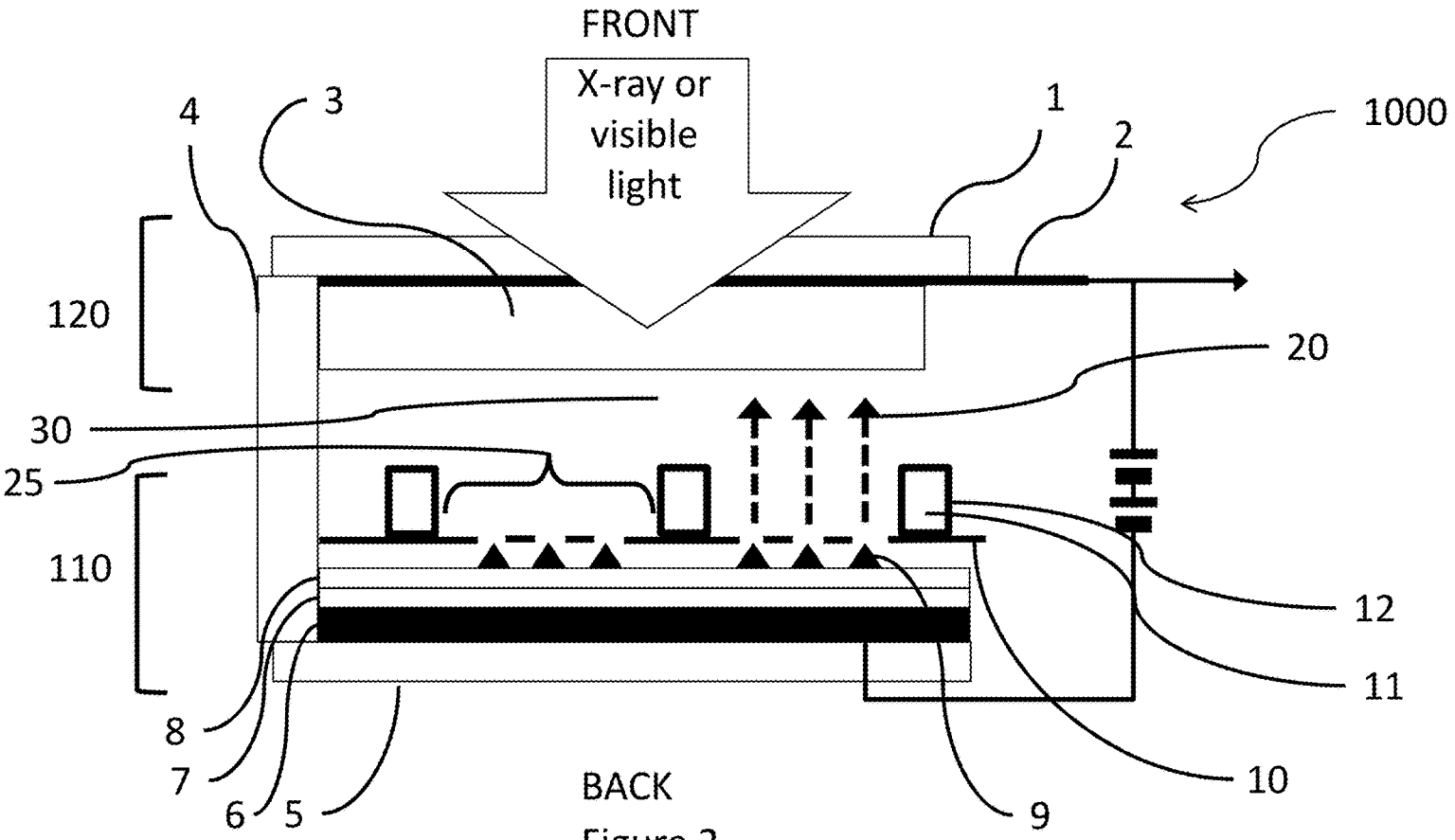
FIG. 2 is a schematic diagram representing an image capture device according to the present disclosure.
Figure 3:
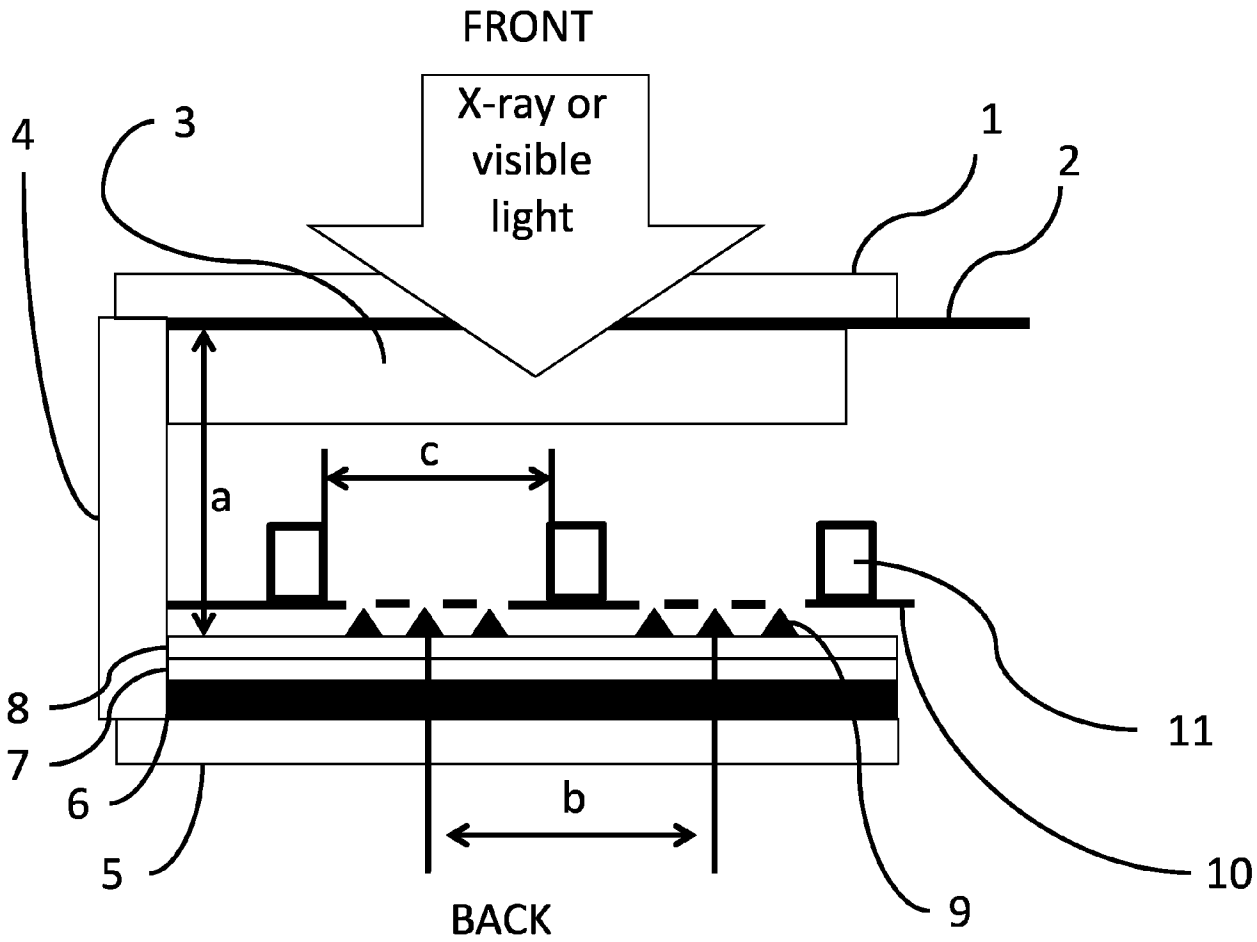
FIG. 3 is a schematic diagram representing the image capture device further indicating the device thickness a, the pixel pitch b and the pixel size c.
Figure 4:
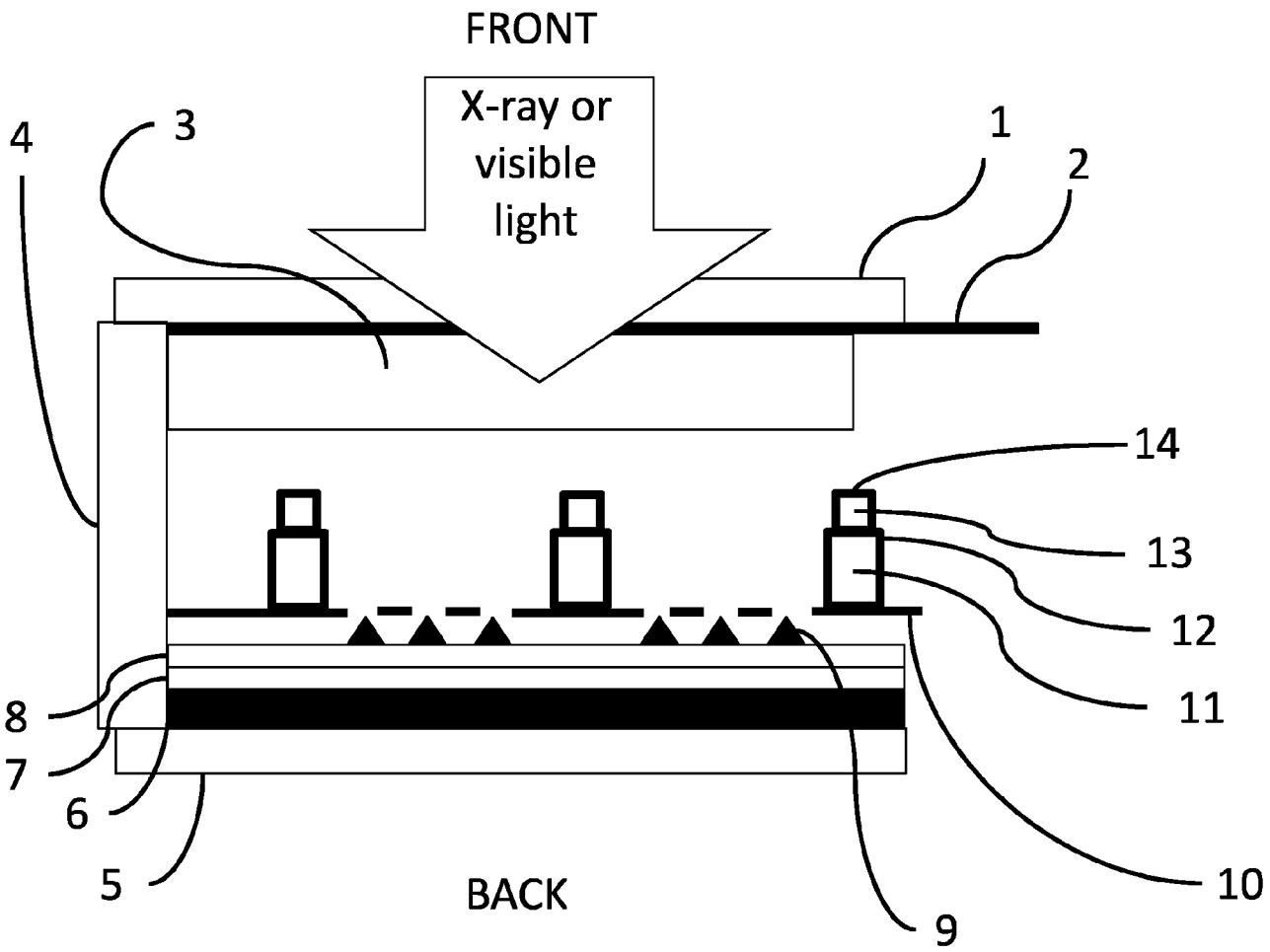
FIG. 4 is a schematic diagram representing the image capture device comprising an array of second focus structures.
Figure 5:
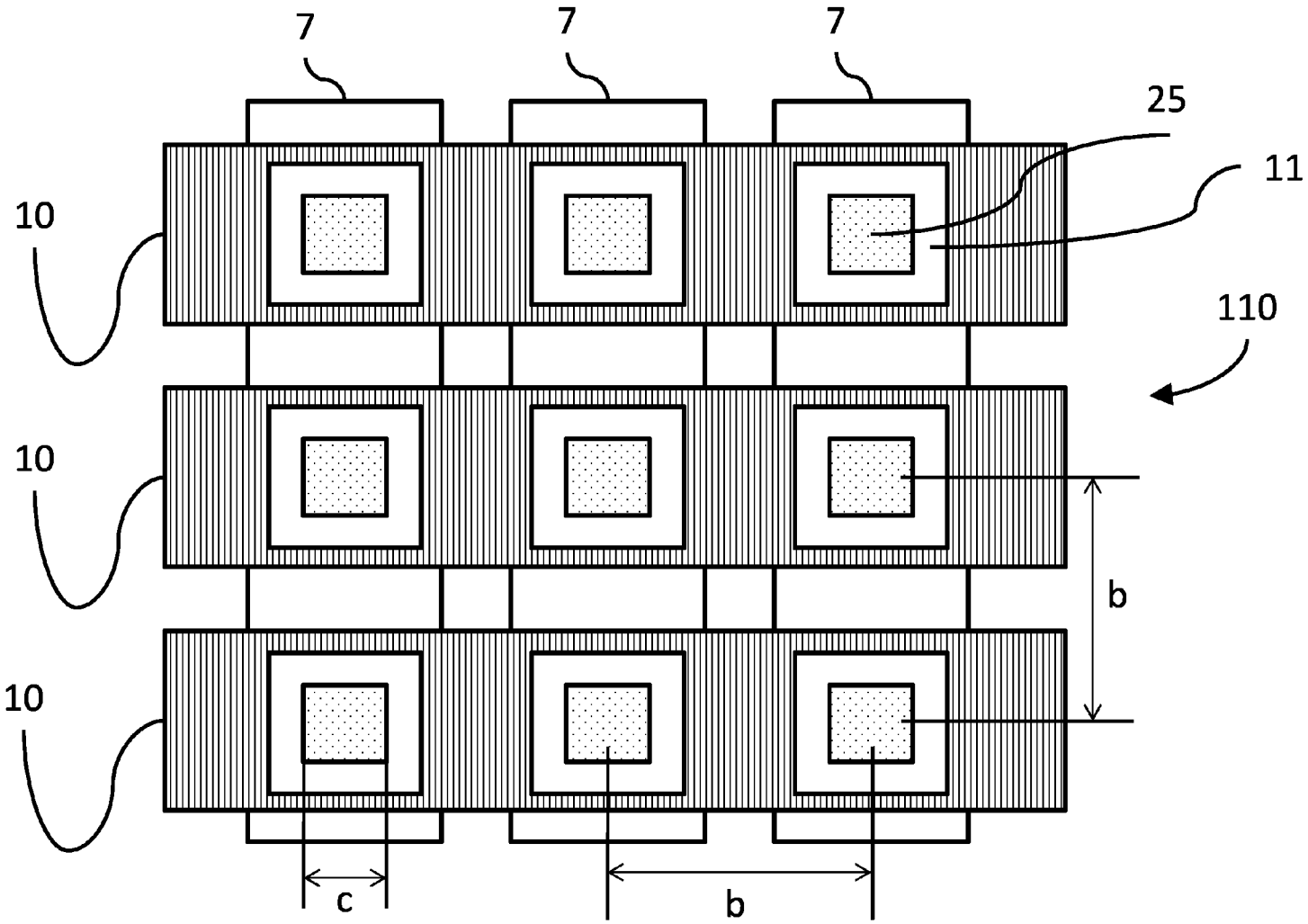
FIG. 5 is a schematic diagram representing an overhead view of the electron emitting construct.

Reference is now made to FIGS. 2-5, which shows an image capture device 1000 of the disclosure. The image capture device 1000 includes an electron emitting construct 110 and an electron receiving construct 120, separated by a spacer 4. The spacer 4 may be situated such that an inner gap 30 is present between the electron receiving construct 120 and the electron emitting construct 110. The inner gap 30 may be sealed and maintained under vacuum, and may provide an unobstructed space between the electron emitting construct 110 and the electron receiving construct 120.

The electron emitting construct 110 may comprise a backplate 5, a substrate 6, a cathode electrode 7, an array of field emission type electron sources 9 and a gate electrode 10. The electron receiving construct 120 may comprise faceplate 1, an anode 2 and an inward facing photoconductor 3. The electron emitting construct 110 may further comprise a plurality of first focus structures 11 arranged in an array, each of said first focus structures 11 comprising a first focus electrode 12. In certain embodiments, the electron emitting construct 110 may further comprise a plurality of second focus structures 13 comprising a second focus electrode 14 (see FIG. 4).

The image capture device may further comprise a resistive layer 8 situated between the cathode 7 and the field emission type electron sources 9, in order to regulate the current into the field emission type electron sources 9.

The field emission type electron source 9 may be activated to emit an electron beam 20 that is directed towards the photoconductor 3. The field emission type electron source 9 is situated between the anode 2 and the cathode 7 such that the electron beam emitted by the field emission type electron source 9 is accelerated towards the anode. The photoconductor 3 may be situated between the emission-type electron source 9 and the anode 2, such that the emitted electrons strike the photoconductor 3.

It is particularly noted that a grid electrode, which is generally situated in a prior art image capture device between the electron emitting construct 110 and the electron receiving construct 120, is not typically present in the image capture device of the disclosure. A grid electrode may be a thin material with an array of small openings having a grid-, mesh- or sieve-like structure, positioned between the anode and cathode. The grid electrode may be referred to as a mesh electrode, a control grid or a trimming electrode. In the prior art system shown in FIG. 1, the grid electrode 20' lies between the electron emitting construct (comprising the field emission type electron source 15) and the electron receiving construct (comprising the faceplate 3). In contradistinction, with reference to FIG. 2, the inner gap 30 of the image capture device of the disclosure provides an unobstructed space between the electron emitting construct 120 and the electron receiving construct 110, such that the electron beam emitted from the field emission type electron source 9 travels directly to the photoconductor 3 without traversing any intermediate construction situated between the electron emitting construct 110 and the electron receiving construct 120.

The Substrate of the Electron Emission Construct

With reference to FIGS. 2-5, the substrate 6 may be a semiconductor material, for example, crystallized silicon. Further, any one of the cathode electrode 7, the resistive layer 8, the field emission type electron source 9, the gate electrode 10, the first focus structure 11, the first focus electrode 12, the second focus structure 13, the second focus electrode 14 and the signal line (not shown), or any combination thereof, may be processed on, and integral to, the substrate 6. In certain embodiments the resistive layer 8 may further be processed on, and integral to, the substrate 6.

The Field Emission Type Electron Source

With reference to FIGS. 2-5, the field emission type electron source 9 may be electrically connected to a driving circuit via a signal line (not shown) and further electrically connected to a gate electrode 10. The coordinated electrical activation of the driving circuit and the gate electrode 10 connected to a field emission type electron source 9 results in its activation, i.e., electron emission. The field emission type electron source 9 performs the electron emission by an electric field formed between the field emission type electron source 9 and the gate electrode 10.

The electron sources 59 may be situated within emitter areas 75 as groups of co-activated units. Each emitter area 75 is connectable to a row driver and a column driver (not shown), which controls the coordination of the activation of the driving circuit and the gate electrode 60 of the electron sources 59.

The field emission type electron source 9 may be, e.g., a Spindt type electron source, a carbon nanotube (CNT) type electron source, a metal-insulator-metal (MIM) type electron source or a metal-insulator-semiconductor (MIS) type electron source. In a preferred embodiment, the electron source 9 may be a Spindt type electron source.

Anode and Cathode

With reference to FIGS. 2-5, the anode 2 and the cathode 7 are configured to generate an electrical field there between. This electrical field accelerates the electrons emitted from the field emission type electron source and directs them towards the photoconductor 3. The anode 2 may be connected to a pre-amplifier, which may further be connected to a pre-pre-amplifier. The strength of the electric field between the anode 2 and the cathode 7 may be 0.1 to 2 volts per micrometers, 0.1 to 1.8 volts per micrometers, 0.1 to 1.5 volts per micrometers, 0.1 to 1 volts per micrometers, 0.1 to 0.5 volts per micrometers, about 0.1 volts per micrometers, about 0.2 volts per micrometers, about 0.3 volts per micrometers, about 0.4 volts per micrometers, about 0.5 volts per micrometers, about 0.6 volts per micrometers, about 0.7 volts per micrometers, about 0.8 volts per micrometers, about 0.9 volts per micrometers, about 1 volts per micrometers, about 1.2 volts per micrometers or about 1.5 volts per micrometers.

Focus Structures

With reference to FIGS. 2-5, a field emission type electron source 9 typically emits electrons having a range of trajectories, referred to as the divergence angle, and not all of the electrons are emitted orthogonal to the electron emission construct 110. As such, a mechanism to correct the trajectory of the electrons, while minimizing the loss of electrons emitted at undesirable trajectories, is desired. The focus structures of the disclosure, e.g., first focus structure 11 comprising a first focus electrode 12 and second focus structure 13 comprising a second focus electrode 14, serve that function.

With reference to FIGS. 2-5, a first focus structure 11 may be configured to surround an emitter area 25, i.e., a unit cell comprising a subset of the plurality of field emission type electron sources 9. The emitter area 25 also defines a pixel size. The first focus electrode 12 may be configured to suppress scatter of the electron beams emitted from the corresponding emitter area 25 through the application of a first focus voltage, thus focusing the emitted electron beam.

In certain embodiments, the image capture device of the disclosure may further comprise, in the electron emitter construct 110, an array of second focus structures 13 comprising a second focus electrode 14. Each second focus structure 13 may be adjacent and inward-facing in relation to each of the first focus structures 11 (with first focus electrodes 12), such that an electron emitting construct 110 comprises, in aggregate, a double focus structure facing the electron receiving construct 120. The second focus electrode 14 may be configured to further accelerate the electrons emitted from the corresponding emitter area 25 through the application of a second focus voltage, thus further focusing the emitted electron beam. It will be appreciated that the electron emitting construct 110 may comprise additional focus structures, resulting in an aggregate focus structure that is tripled, quadrupled, or the like.

The focus structures with the focus electrodes (e.g., first focus structure 11 with first focus structure 12 and/or second focus structure 13 with second focus structure 14) may further function as a drain for misdirected electrons. In certain embodiments, the first focus electrode 12 may be positioned to cover a signal line of the driving circuit for the field emission type electron source 9, thus reducing radiation noise in the signal lines by protecting the signal lines from irradiation by misdirected electrons.

It is particularly noted that a focus structure such as described herein may be used in the electron emitting construct of an image capture device or of an x-ray emitting device as suits requirements.

Pixel Pitch and Device Thickness

As described above, and with reference to FIGS. 2-5, the first focus structure 11 may surround an emitter area 25, i.e., a unit cell comprising a subset of said field emission type electron sources 9. The subset of field emission type electron sources 9 within an emitter area 25 may define a pixel for the image capture device.

Pixel pitch is a specification of a pixel-based image capture device that is known in the art. Pixel pitch may be expressed, e.g., as the distance between adjacent pixels. See, e.g., distance b in FIG. 3. Pixel size may be expressed as the area, width and length (if rectangular), or diameter (if circular) of, e.g. the emitter area 25. See, e.g., distance c in FIG. 3. Smaller pixel size and pixel pitch contribute to a finer resolution of the image that the device of the disclosure captures.

Another specification used in flat panel image capture devices is device thickness. The thickness of the image capture device may be expressed as, e.g., the distance between a field emission type electron source 9 and the orthogonal position on the anode 2 (shown as distance a in FIG. 3). The thickness of the device may, alternatively, be expressed as the orthogonal distance between the anode 2 and the cathode 7, or as the orthogonal distance between any one component of the electron receiving construct 120 (e.g., the faceplate 1, the anode 2 or the photoconductor 3) and any one component of the electron emitting construct 110 (e.g., the field emission type electron source 9, the cathode 7, the substrate 6 and the backplate 5).

A discussed above, the image capture device of the disclosure is designed to improve electron utilization efficiency of the image capture device, i.e., to increase the portion of electrons being emitted from the field emission type electron source 9 that strike the predetermined location on the photoconductor 3. As such, in the present disclosure, each emitter area 25 of the image capture device (i.e., the cell comprising a plurality of field emission type electron sources 9 surrounded by a first focus structure 11) may require a lower density of electrons being emitted from the electron sources in order to achieve the same density of electrons striking the photoconductor 3, when compared to prior art image capture devices. Further, each emitter area 25 may thus require fewer field emission type electron sources and, thus, the pixel size, as well as the pixel pitch, of the image capture device of the disclosure may be made smaller. The pixel of the image capture device of the disclosure may be a square pixel with the pixel pitch of, e.g., between 10 micrometers and 1000 micrometers, between 50 micrometers and 200 micrometers, about 50 micrometers, about 75 micrometers, about 100 micrometers, about 125 micrometers, about 150 micrometers or about 200 micrometers. Preferably, the pixel of the image capture device of the disclosure may be a square pixel with the pixel pitch of about micrometers 100 micrometers.

Typically, a thinner image capture device may be desired. However, thinner devices are more difficult to assemble, and the presence of a grid electrode exacerbates the difficulty in assembly. It is a particular advantage of the present disclosure that, because a grid electrode may not be used, the image capture device may be made thinner, or the same thinness may be produced at less cost, when compared to prior art image capture devices that comprise a grid electrode.

Another specification of a flat panel image capture device is the ratio between pixel pitch and device thickness. In the image capture device of the disclosure, the device thickness, e.g., the distance between the cathode 7 and the anode 2, is from 0.5 to 4.0 times the pixel pitch. Expressed in an alternative fashion, the ratio between device thickness and pixel pitch (i.e., device thickness in micrometers/pixel pitch in micrometers) is between 0.5 and 4.0. Given the above ratio, if the pixel pitch is 100 micrometers, the gap between the cathode 7 and the anode 2 would be between 50 and 400 micrometers. In certain embodiments, the device thickness, e.g., the distance between the cathode 7 and the anode 2, is from 0.5 to 2.0 times the pixel pitch, from 0.5 to 1.5 times the pixel pitch, from 1 to 3 times the pixel pitch, from 1 to 4 times the pixel pitch, about 0.5 times the pixel pitch, about 0.75 times the pixel pitch, about 1 times the pixel pitch, about 1.5 times the pixel pitch, about 1.75 times the pixel pitch, about 2 times the pixel pitch, about 2.25 times the pixel pitch, about 2.5 times the pixel pitch, about 2.75 times the pixel pitch, about 3 times the pixel pitch, about 3.25 times the pixel pitch, about 3.5 times the pixel pitch, about 3.75 times the pixel pitch or about 4 times the pixel pitch. The parameters of the field emission type electron source 9, the dimensions of the focus structures 11 (and 13), the voltage loaded to the focus electrodes 12 (and 14), and the height of the spacer 4, and other parameters of the device may be adjusted as needed.

The Electron Receiving Construct

With reference to FIGS. 2-5, the electron receiving construct 120 may include a faceplate 1, an anode electrode 2, and a photoconductor 3.

The faceplate 1 may be constructed of a material and/or in a configuration that transmits incident electromagnetic radiation radiating from the front of the faceplate 1. The faceplate 1 may be capable of transmitting high energy electromagnetic waves such as X-rays or gamma-ways and visible light. Alternatively, the faceplate 1 may allow transmission of high energy electromagnetic waves such as X-rays or gamma-ways but prevent the transmission of visible light.

As a further alternative, the faceplate 1 may comprise a scintillator. The scintillator may be capable of converting high energy electromagnetic waves such as X-rays or gamma-ways into light in the visible spectrum. The scintillator also may have high X-ray (or gamma-ray) stopping power, preventing or reducing X-rays (or gamma-rays) to be transmitted through it. Various scintillator materials are known in the art. The scintillator may comprise, for example, crystalline Cesium Iodide (CsI). The CsI may be doped, for example, with Sodium or Thallium. The CsI-based scintillator may be a high resolution type or a high light output type.

Figure 6A:
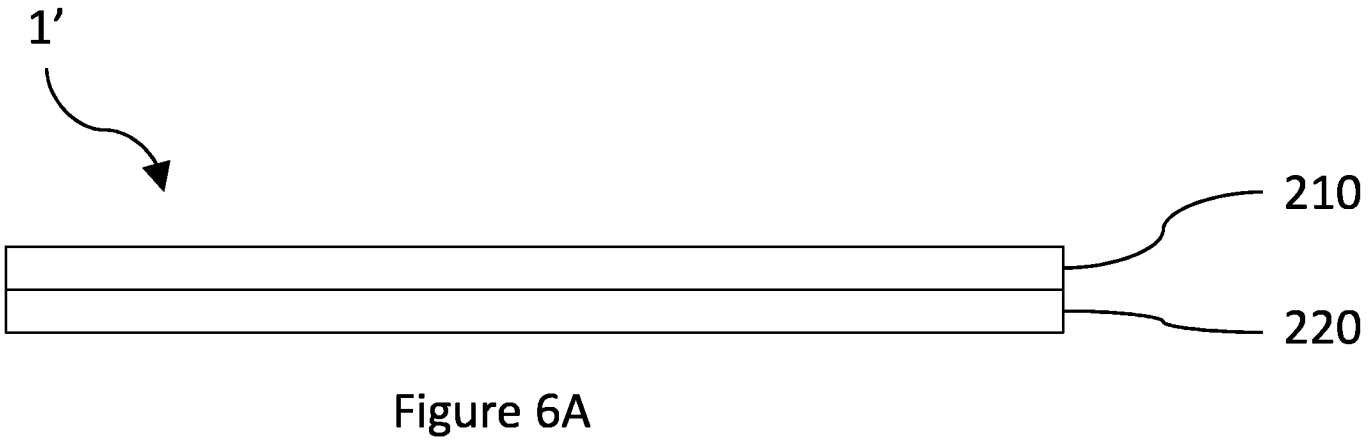
FIGS. 6A-B are schematic diagrams representing a detailed view of a faceplate with multiple layers.
Figure 6B:
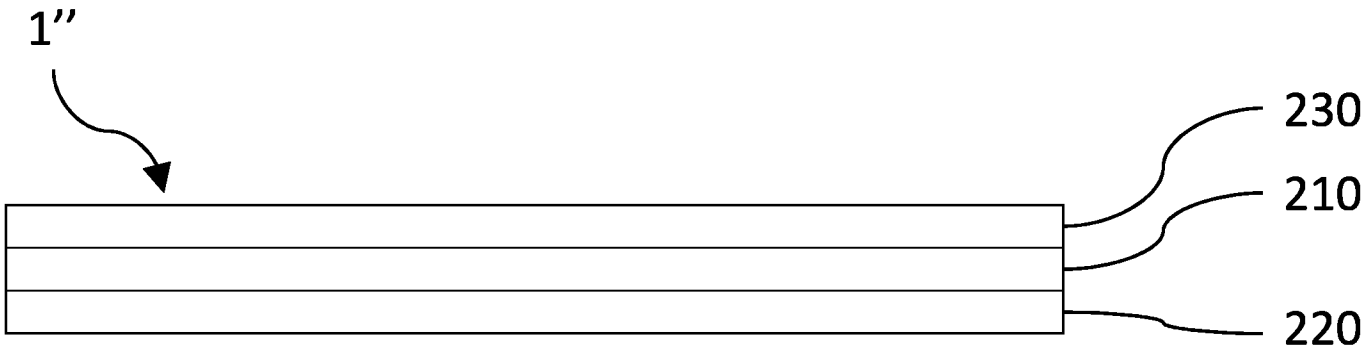

With reference to FIGS. 6A-B, the faceplate may include multiple layers. With reference to FIG. 6A, the faceplate 1' may include an outward facing scintillator 210 and an inward facing fiber optic plate (FOP) 220. The thickness of the scintillator 210 may be, for example, about 50 microns, about 75 microns, about 100 microns, about 125 microns, about 150 microns, about 175 microns, about 200 microns, about 225 microns, about 250 microns, about 275 microns, about 300 microns, about 350 microns, about 400 microns, about 450 microns, about 500 microns, about 525 microns, about 550 microns, about 575 microns, about 600 microns, about 625 microns, about 650 microns, about 675 microns, about 700 microns, about 800 microns, about 1 millimeter, about 1.2 millimeter, about 1.4 millimeters, about 1.5 millimeters, about 1.6 millimeters, about 1.8 millimeters, about 2 millimeters, about 2.2 millimeters, about 2.4 millimeters, about 2.5 millimeters, about 2.6 millimeters, about 2.8 millimeters, about 3 millimeters or about 3.2 millimeters. The thickness of the FOP 220 may be, for example, about 0.5 millimeter, about 1 millimeter, about 1.5 millimeters, about 2 millimeters, about 2.5 millimeters, about 3 millimeters, about 3.5 millimeters, about 4 millimeters, about 4.5 millimeters, or about 5 millimeters.

With reference to FIG. 6B, the faceplate 1" may further include an outward facing protective layer 230. The protective layer 230 may provide physical protection from, e.g., impact or scratching. The protective layer may transmit high energy electromagnetic waves such as X-rays or gamma-ways while preventing transmission of light in the visible spectrum. The protective layer 230 may comprise, for example, one or more layers composed of, for example, foam or carbon.

A FOP is an optical instrument that is a collection of a large number of optical fibers bundled together. The optical fibers are typically several microns in diameter. An FOP is capable of transferring light and image with high efficiency and low distortion, Various FOPs are known in the art.

The multiple layers of the faceplate may be permanently attached to each other with, e.g., a glue or bonding element. Alternatively, they may be attached with a temporary means, for example, a clamp, a clip or the like, to facilitate the exchange of alternative types of one or more of the layers.

The anode electrode 2 may be constructed of materials and/or in a configuration that transmits incident electromagnetic radiation radiating from the front of the faceplate 1, or the electromagnetic radiation emitted from the scintillator 15, such that the incident electromagnetic radiation reaches the photoconductor 3.

Materials used for the photoconductor 3 are known in the art, e.g., amorphous Selenium (a-Se), $HgI_2$, $PHI_2$, CdZnTe, or PbO. In a preferred embodiment, the photoconductor 3 comprises amorphous Selenium. The thickness of the photoconductor 3 may be, for example, about 5 microns, about 10 microns, about 12.5 microns, about 15 microns, about 17.5 microns, about 20 microns, about 25 microns, about 30 microns, about 50 microns, about 0.1 millimeters, about 0.25 millimeters, about 0.5 millimeter, about 1 millimeter, about 1.5 millimeters, about 2 millimeters, about 2.5 millimeters, about 3 millimeters, about 3.5 millimeters, about 4 millimeters, about 4.5 millimeters, or about 5 millimeters.

Figure 7A:
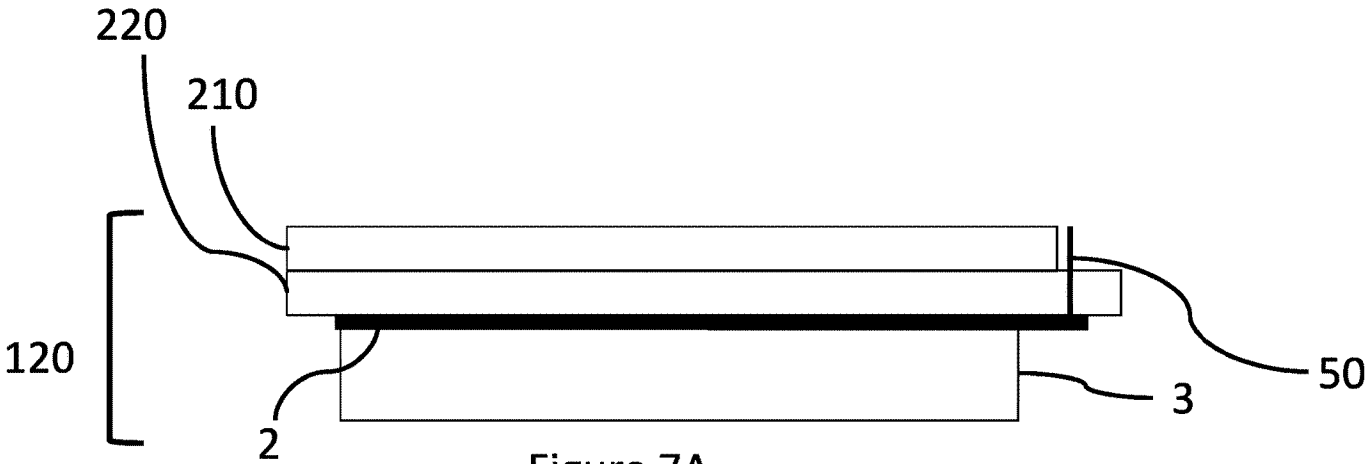
FIGS. 7A-B are schematic diagrams representing possible arrangements a high voltage pin in relation to a fiber optic plate and a scintillator.
Figure 7B:
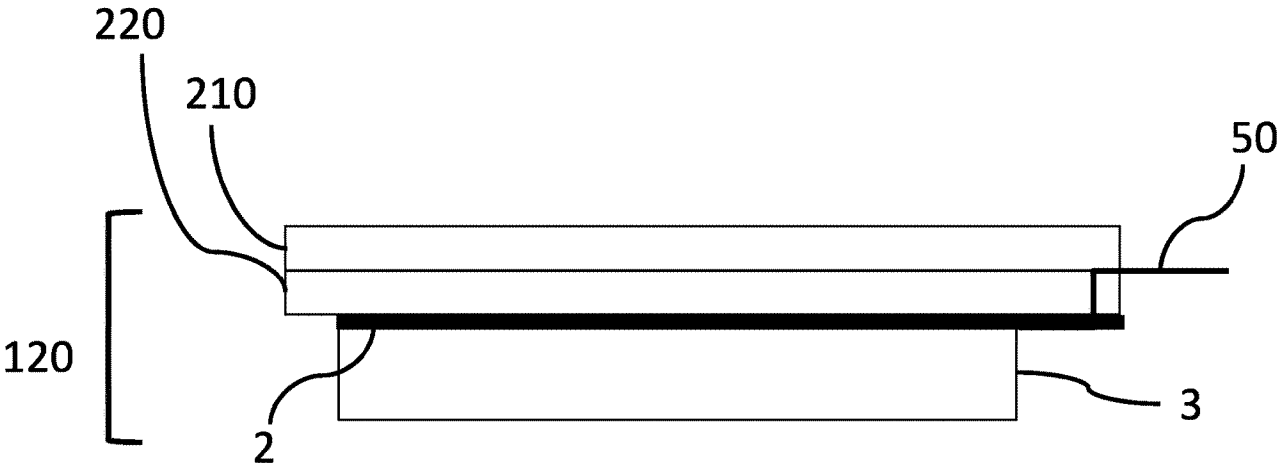

With reference to FIGS. 7A-B, the anode 2 may be connected to a high voltage (HV) pin 50, which goes through the FOP 220 and exits the faceplate comprising the FOP 220 and the scintillator 210 to connect to further circuitry. As shown in FIG. 7A, the scintillator 210 may be smaller in dimension compared to the FOP 220, or offset from the FOP 220, to enable the HV pin 50 to be exposed out from the faceplate for further connection. Alternatively, as shown in FIG. 7B, the HV pin 50 may go through the FOP, then be situated between the FOP 220 and the scintillator 210 and be exposed for further connection out of the side of the faceplate 1.

The electromagnetic radiation may be of any frequency. In certain embodiments, the electromagnetic radiation may be in the X-ray frequency range. X-rays may me characterized by an energy of, e.g., about 60 keV, about 65 keV, about 70 keV, about 75 keV, about 80 keV, about 85 keV, about 95 keV, about 100 keV, or between 70 and 80 keV. Alternatively, the electromagnetic radiation may be in the HEX-ray frequency range. HEX-rays may be characterized by an energy of, e.g., above 100 keV, above 200 keV, or above 300 keV. Alternatively, the electromagnetic radiation may be in the gamma-ray frequency range. Alternatively, the electromagnetic radiation may be in the visible light frequency range.

An Embodiment of the Image Capture Device

Figure 8A:
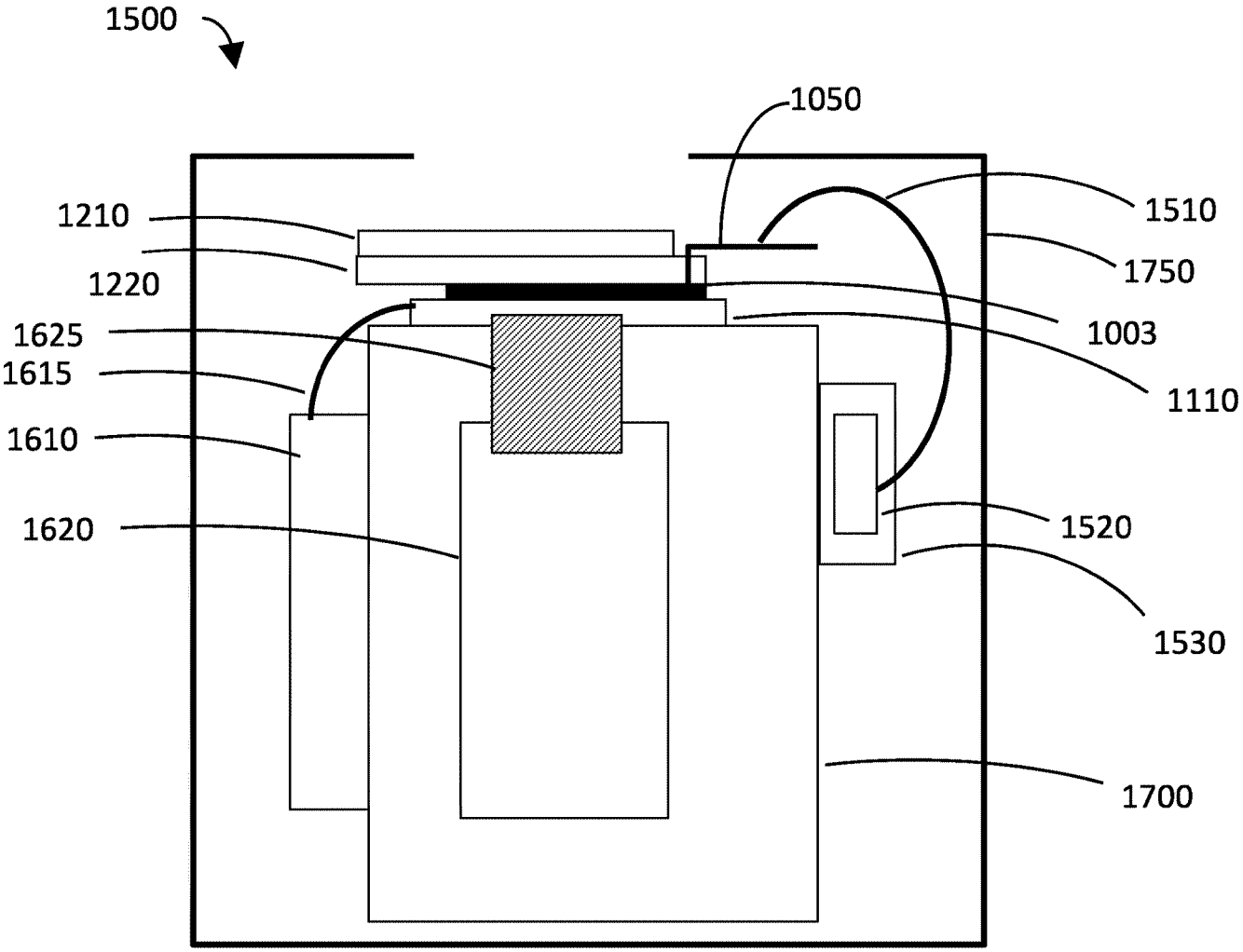
FIGS. 8A-B are schematic diagrams showing the side view and top view (respectively) of an embodiment of an image capture device.

FIG. 8A shows the side view schematic of a particular embodiment of an image capture device 1000. The image capture device may include a chassis 1700 supporting an electron emitting construct 1110 and an electron receiving construct that may include a photoconductor 1003, an anode (not shown) an FOP 1220 and a scintillator 1210. A high voltage (HV) pin 1050 may be connected to the anode. The chassis may further support a pr-pre-amplifier 1520 enclosed in a shield case 1530. The HV pin 1050 and the pre-pre-amplifier may be connected via a HV contact 1510. The chassis may further support a row driver 1610 that is connected to the electron emitting construct 1110 via a flexible printec circuit 1615. The chassis may further support a column driver 1620 that is connected to the electron emitting construct 1110 via a flexible printec circuit 1625. The image capture device may further include a housing unit 1750 that fully covers the exterior. The housing unit may have an opening on the side of the chassis 1710 with the electron emitting construct 1110 together with the photoconductor 1003.

Figure 8B:
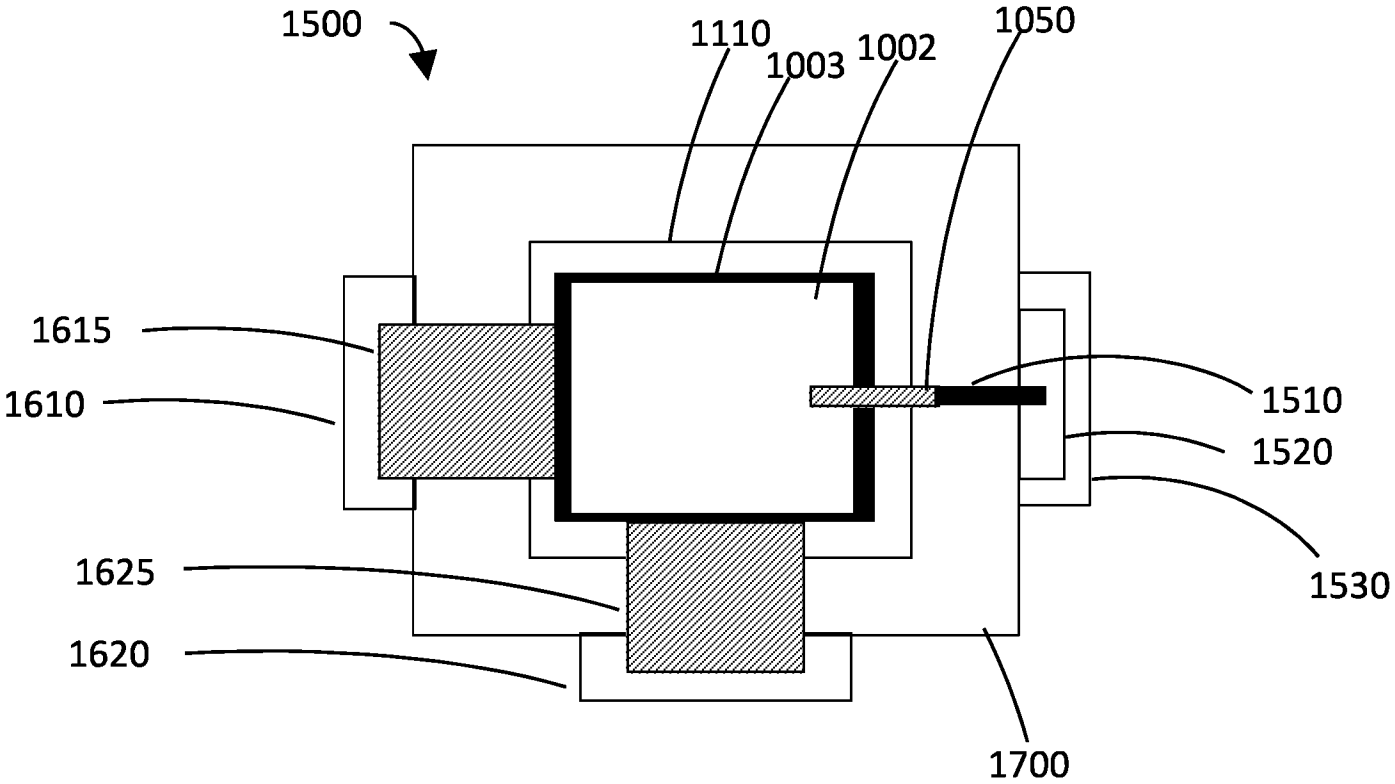

FIG. 8B shows the top view schematic of a particular embodiment of the image capture device 1000. For clarity, the faceplate (including the FOP 1220 the scintillator 1220) and the housing unit 1750, shown in FIG. 8A, are not shown in the top view for clarity. The anode 1002, not shown in FIG. 8A, is shown.

Functional Parameters

The image capture device may have a signal to noise ratio (S/N or SNR) of, for example, between 60 to 80 decibels (dB), between 70 and 90 dB, between 90 and 130 dB, between 80 and 100 dB, between 100 and 130 dB, between 50 and 70 dB, between 30 and 40 dB, between 35 and 45 dB, between 40 and 50 dB, between 55 and 65 dB, between 60 and 70 dB, between 65 and 75 dB, between 70 and 80 dB, about 30 dB, about 35 dB, about 40 dB, about 45 dB, about 50 dB, about 55 dB, about 60 dB, about 65 dB, about 70 dB, about 75 dB, about 80 dB, about 85 dB, about 90 dB, about 100 dB, about 110 dB, about 120 dB, or about 130 dB. Signal-to-noise ratio is typically defined as the power ratio between a signal (meaningful information) and the background noise (unwanted signal) and expressed as, e.g., $S/N=P_S/P_N$, where $P_S$ is the power of the signal and $P_N$ is the power of the noise. If the signal and the noise are measured across the same impedance, then the S/N may be obtained by calculating the square of the amplitude ratio, i.e., $S/N=P_S/P_N, =(A_S/A_N)^2$, where $A_S$ is the amplitude of the signal and $A_N$ is the power of the noise. As such, the signal to noise ratio may be expressed as S/N (in dB)=$10 \log_{10}(P_S/P_N)$ or S/N (in dB)=$20 \log_{10}(A_S/A_N)$. Where the signal is measured as voltage, S/N may be calculated based on the formula of, for example S/N (in dB)=$20 \log_{10}(V_S/V_N)$, where $V_S$ may be the voltage of the signal and $V_N$ may be the voltage of the noise. The S/N may be calculated from images accumulated and/or averaged over, for example, 1 to 15 frames, 2 frames, 3 frames, 4 frames, 5 frames, 6 frames, 7 frames, frames, 8 frames, 9 frames, 10 frames, 11 frames, 12 frames, 13 frames, 14 frames, 15 frames, 16 frames, 17 frames, 18 frames, 19 frames, 20 frames, or more than 20 frames.

The image capture device may have a spatial resolution of, for example, about 30% at 1 line pair/millimeter (lp/mm), about 35% at 1 lp/mm, about 40% at 1 lp/mm, about 45% at 1 lp/mm, about 50% at 1 lp/mm, about 55% at 1 lp/mm, about 60% at 1 lp/mm, about 65% at 1 lp/mm, about 70% at 1 lp/mm, about 75% at 1 lp/mm, about 80% at 1 lp/mm, or more than 50% at 1 lp/mm.

The image capture device may configured to capture images at a frame rate of, for example, about 15 fps, about 30 fps, about 45 fps, about 50 fps, about 60 fps, about 75 fps, about 80 fps, about 90 fps, up to 50 fps, up to 60 fps, up to 90 fps, between 50 and 60 fps, or between 60 and 90 fps.

The image capture device may have a temporal performance of a lag time of, for example, less than 1 frame at 15 frames per second (fps), less than 1 frame at 30 fps, less than 1 frame at 45 fps, less than 1 frame at 50 fps, less than 1 frame at 60 fps, less than 1 frame at 75 fps, or less than 1 frame at 90 fps.

X-Ray Emitting Device

Figure 9:
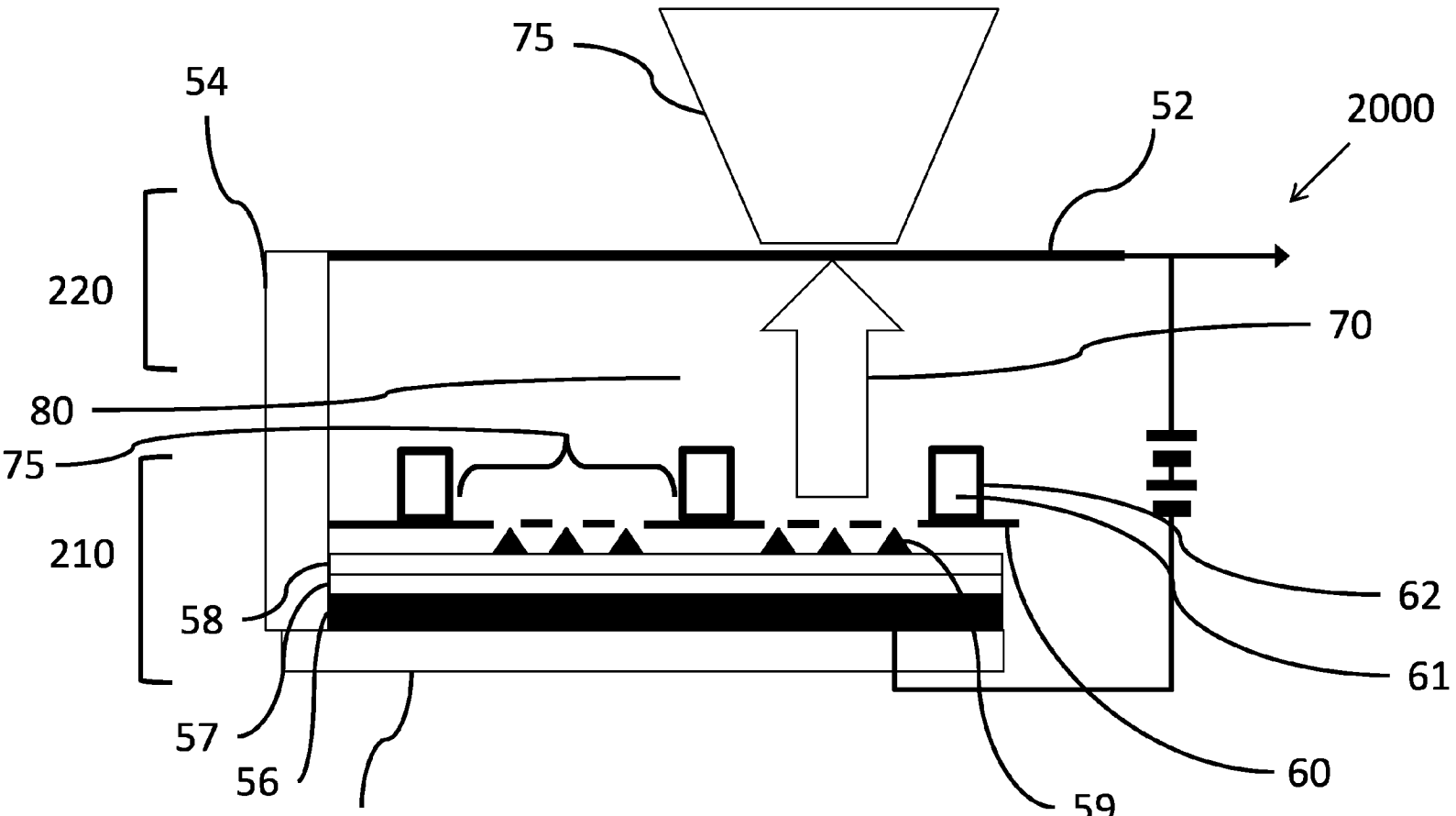
FIG. 9 is a schematic diagram representing an x-ray emitting device according to the present disclosure.

Reference is now made to FIG. 9, which shows an x-ray emitting device 2000 of the disclosure. The x-ray emitting device 2000 includes an electron emitting construct 210 and an x-ray emitter 220, separated by at least one spacer 54. The spacer 54 may be situated such that an inner gap 80 is present between the x-ray emitter 220 and the electron emitting construct 210. The inner gap 80 may be sealed and maintained under vacuum, and may provide an unobstructed space between the electron emitting construct 210 and the x-ray emitter 220.

Electron Emitting Construct

The various options described for the electron emitting construct 110 and its components as described with reference to FIGS. 2-5 are also options for the electron emitting construct 210.

The electron emitting construct 210 may comprise a backplate 55, a substrate 56, a cathode electrode 57, resistive layer 58, an array of field emission type electron sources 59 and a gate electrode 60. The electron emitting construct 210 may further comprise a plurality of first focus structures 61 arranged in an array, each of said first focus structures 61 comprising a first focus electrode 62. In certain embodiments, the electron emitting construct 210 may further comprise a plurality of second focus structures 63 comprising a second focus electrode 64 (see FIG. 10).

The field emission type electron source 59 may be activated to emit an electron beam 20 that is directed towards the x-ray emitter 220. The field emission type electron source 59 is situated between the anode 52 and the cathode 57 such that the electron beam 70 emitted by the field emission type electron source 59 is accelerated towards the anode 52.

The electron sources 59 may be situated within an emitter area 75 as a group of co-activatable units.

It is particularly noted that in a prior art image capture devices a grid electrode has been generally situated between the electron emitting construct 210 and the x-ray emitting construct 220. A grid electrode may be a thin material with an array of small openings having a grid-, mesh- or sieve-like structure, positioned between the anode and cathode. The grid electrode may be referred to as a mesh electrode, a control grid or a trimming electrode.

Figure 10:
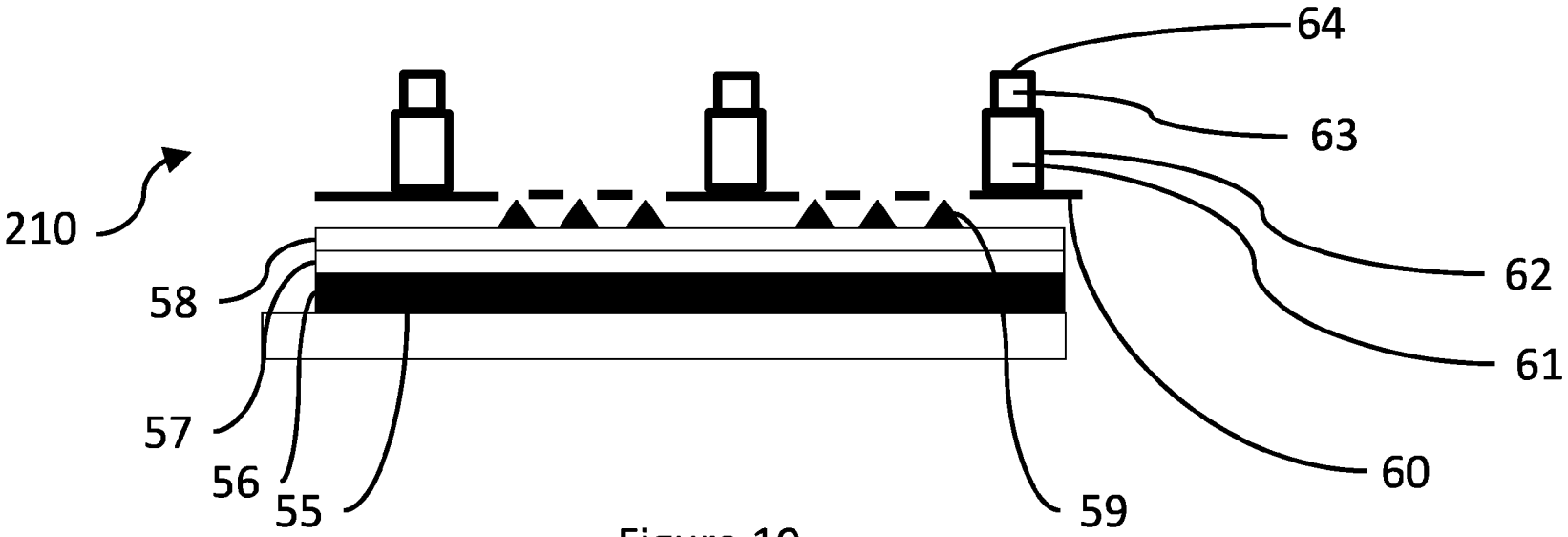
FIG. 10 is a schematic diagram representing electron emitting construct of the x-ray emitting device comprising an array of second focus structures.

In contradistinction to the prior art, the grid electrode is not typically present in the image capture device of the disclosure. With reference to FIG. 10, the inner gap 80 of the image capture device of the disclosure provides an unobstructed space between the electron emitting construct 220 and the electron receiving construct 210, such that the electron beam emitted from the field emission type electron source 59 travels directly to the x-ray emission construct 220 without traversing any intermediate construction situated between the electron emitting construct 210 and the x-ray emitter 220.

The Substrate of the Electron Emission Construct

With reference to FIG. 9, the substrate 56 may be a semiconductor material, for example, crystallized silicon. Further, any one of the cathode electrode 57, the resistive layer (not shown), the field emission type electron source 59, the gate electrode 60, the first focus structure 61, the first focus electrode 62, the second focus structure 58, the second focus electrode (not shown) and the signal line (not shown), or any combination thereof, may be processed on, and integral to, the substrate 56. In certain embodiments the resistive layer may further be processed on, and integral to, the substrate 56.

It is particularly noted that, alternatively or additionally, where required, the focus structure of the x-ray emitting device may be independent or disconnected from the cathode plate.

The Field Emission Type Electron Source

With reference to FIG. 9, the field emission type electron source 59 may be electrically connected to a driving circuit via a signal line (not shown) and further electrically connected to a gate electrode 60. The coordinated electrical activation of the driving circuit and the gate electrode 60 connected to a field emission type electron source 59 results in its activation, i.e., electron emission. The field emission type electron source 59 performs the electron emission by an electric field formed between the field emission type electron source 59 and the gate electrode 60.

The electron sources 59 may be situated within emitter areas 75 as groups of co-activated units. Each emitter area 75 is connectable to a row driver and a column driver (not shown), which controls the coordination of the activation of the driving circuit and the gate electrode 60 of the electron sources 59.

The field emission type electron source 59 may be, e.g., a Spindt type electron source, a carbon nanotube (CNT) type electron source, a metal-insulator-metal (MIM) type electron source or a metal-insulator-semiconductor (MIS) type electron source. In a preferred embodiment, the electron source 59 may be a Spindt type electron source.

Anode and Cathode

With reference to FIG. 9, the anode 52 and the cathode 57 are configured to generate an electrical field therebetween. This electrical field accelerates the electrons emitted from the field emission type electron source and directs them towards the anode 52. The anode 52 may be connected to a pre-amplifier, which may further be connected to a pre-pre-amplifier. The strength of the electric field between the anode 52 and the cathode 57 may be 0.1 to 2 volts per micrometers, 0.1 to 1.8 volts per micrometers, 0.1 to 1.5 volts per micrometers, 0.1 to 1 volts per micrometers, 0.1 to 0.5 volts per micrometers, about 0.1 volts per micrometers, about 0.2 volts per micrometers, about 0.3 volts per micrometers, about 0.4 volts per micrometers, about 0.5 volts per micrometers, about 0.6 volts per micrometers, about 0.7 volts per micrometers, about 0.8 volts per micrometers, about 0.9 volts per micrometers, about 1 volts per micrometers, about 1.2 volts per micrometers or about 1.5 volts per micrometers.

Focus Structures

With reference to FIG. 9, a field emission type electron source 59 typically emits electrons having a range of trajectories, referred to as the divergence angle, and not all of the electrons are emitted orthogonal to the electron emission construct 210. As such, a mechanism to correct the trajectory of the electrons, while minimizing the loss of electrons emitted at undesirable trajectories, is desired. The focus structures of the disclosure, e.g., first focus structure 61 comprising a first focus electrode 62.

With reference to FIG. 9, the first focus structure 61 may be configured to surround an emitter area 75, i.e., a unit cell comprising a subset of the plurality of field emission type electron sources 59. The first focus electrode 62 may be configured to suppress scatter of the electron beams emitted from the corresponding emitter area 75 through the application of a first focus voltage, thus focusing the emitted electron beam.

Referring now to FIG. 10, in certain embodiments, the electron emitter construct 210 may comprise an array of second focus structures 63 comprising a second focus electrode 64. Each second focus structure 63 may be adjacent and inward-facing in relation to each of the first focus structures 61 (with first focus electrodes 62), such that an electron emitting construct 210 comprises, in aggregate, a double focus structure facing the x-ray emitter 220. The second focus electrode 64 may be configured to further accelerate the electrons emitted from the corresponding emitter area 75 through the application of a second focus voltage, thus further focusing the emitted electron beam. It will be appreciated that the electron emitting construct 210 may comprise additional focus structures, resulting in an aggregate focus structure that is tripled, quadrupled, or the like.

The focus structures with the focus electrodes (e.g., first focus structure 61 with first focus structure 62 and/or second focus structure 63 with second focus structure 64) may further function as a drain for misdirected electrons. In certain embodiments, the first focus electrode 62 may be positioned to cover a signal line of the driving circuit for the field emission type electron source 59, thus reducing radiation noise in the signal lines by protecting the signal lines from irradiation by misdirected electrons.

X-Ray Emitter

With reference to back to FIG. 9, the x-ray emitter 220 is situated to face the electron emission structure 210, and includes the anode 52 that is capable of emitting x-rays when struck with an electron beam. Such anodes 52 are known in the art and may also be referred to as "targets" or "x-ray targets". The anode 52 may be constructed of molybdenum, rhodium, tungsten, or a combination thereof.

Figure 11:
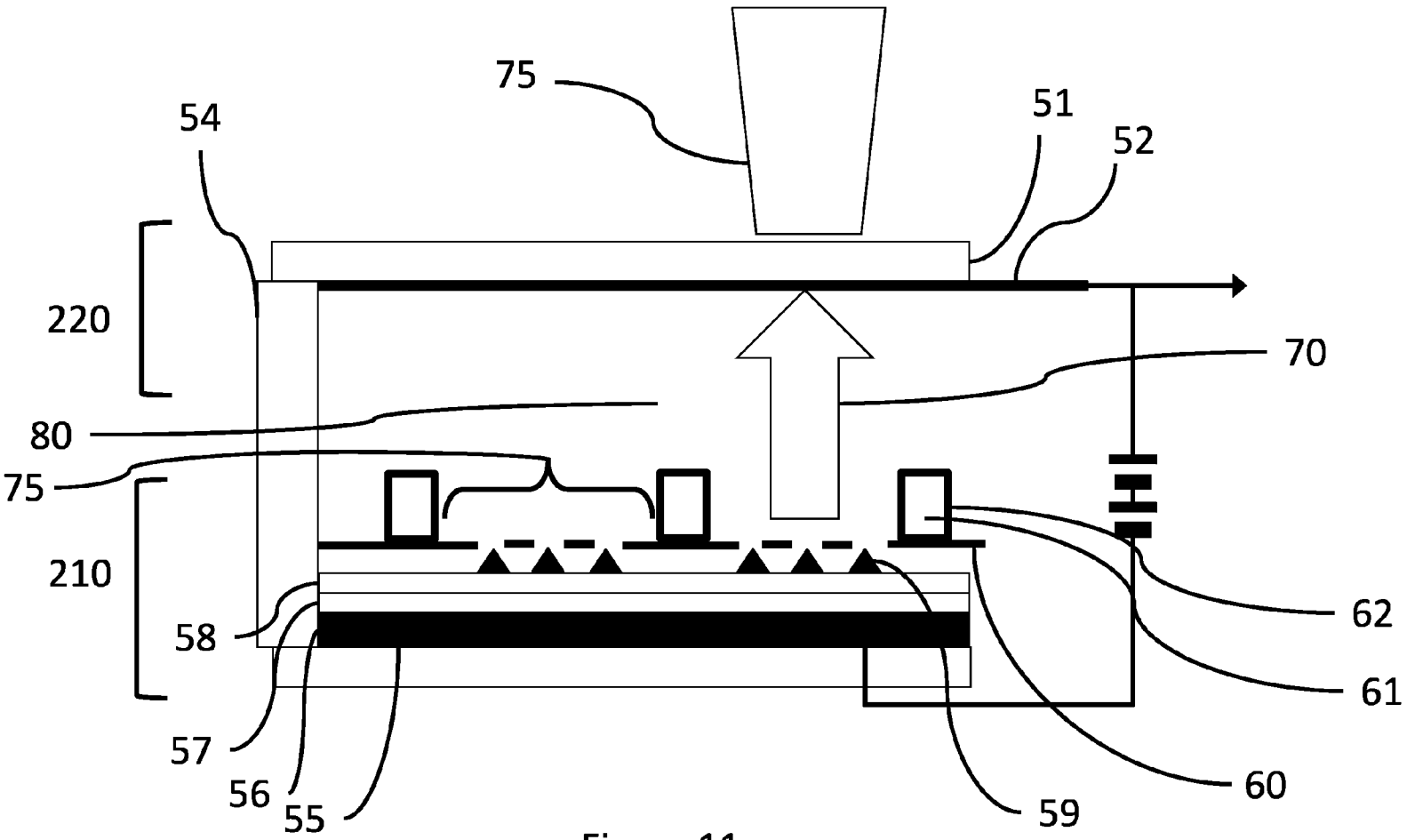
FIG. 11 is a schematic diagram representing the x-ray emitting device further comprising a collimator.

Referring now to FIG. 11, the X-ray emitter 220 may further include a collimator 51. Typically, the x-rays 70 are emitted in a range of directions, such that they radiate from the x-ray emitter 220 in a conical fashion. Collimators are devices that filter a stream of rays so that only those traveling parallel to a specified direction are allowed through. As such, the spread of the emitted x-rays may be minimized or eliminated.

Coordinated Activation of Electron Emitter Areas

As discussed above with reference to FIGS. 2-5, in the image capture device 1000, the electron sources 9 may be situated within emitter areas 25 as groups of co-activated units. Each emitter area 25 is connectable to a row driver and a column driver (not shown), which controls the coordination of the activation of the driving circuit and the gate electrode 10 of the electron sources 9. As such, each emitter area 25 is capable of being turned on and off individually. Thus, with the image capture device 1000, the electron sources 9 may be activated in various spatial and temporal patterns.

For example, the image capture device 1000 may scan the photoconductor 3 to detect the location of electron holes therein, which information is then processed to form an image. In addition, the image capture device 1000 may limit the scanning to a predetermined subset of emitter areas 25 within the electron emitting construct. Such a limitation may be useful in limiting scanning time or in limiting the area of detection to reduce noise by avoiding the detection of scattered electromagnetic waves.

Coordinated Activation of X-Ray Emission

As discussed above with reference to FIG. 9, in the x-ray emitting device 2000, the electron sources 59 may be situated within emitter areas 75 as groups of co-activated units. Each emitter area 75 is connectable to a row driver and a column driver (not shown), which controls the coordination of the activation of the driving circuit and the gate electrode 60 of the electron sources 59. As such, each emitter area 75 is capable of being turned on and off individually. Thus, using the x-ray emitting device 2000, x-rays may be emitted in various spatial and temporal patterns.

Figure 12:
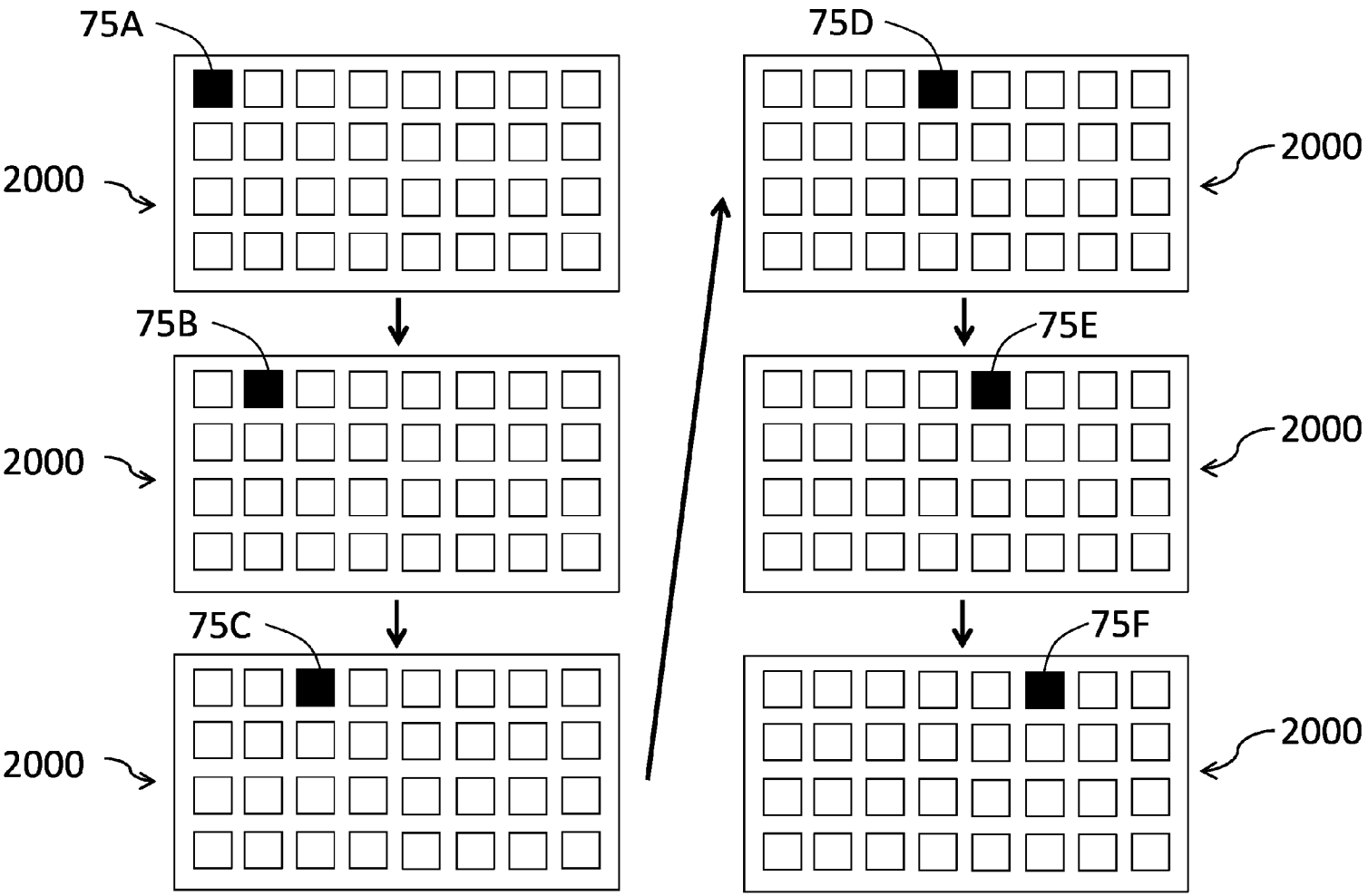
FIG. 12 is a schematic diagram showing the sequential activation of multiple emitter areas.

For example, a series of emitter areas 75A-F may be sequentially activated, resulting in a virtual scan that is equivalent to a mechanically moving x-ray source (FIG. 12).

Figure 13:
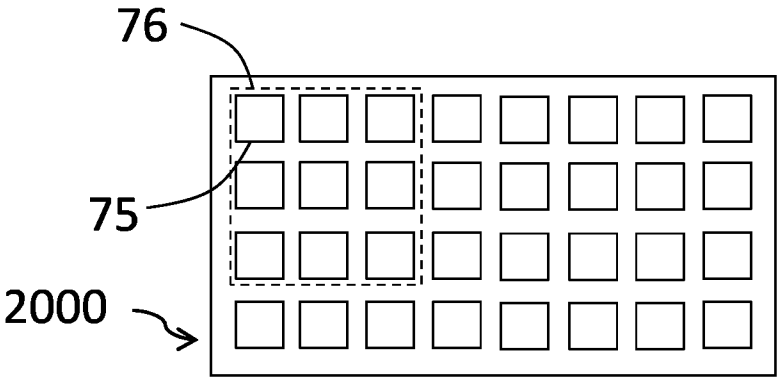
FIG. 13 is a schematic diagram showing a projection module.
Figure 14:
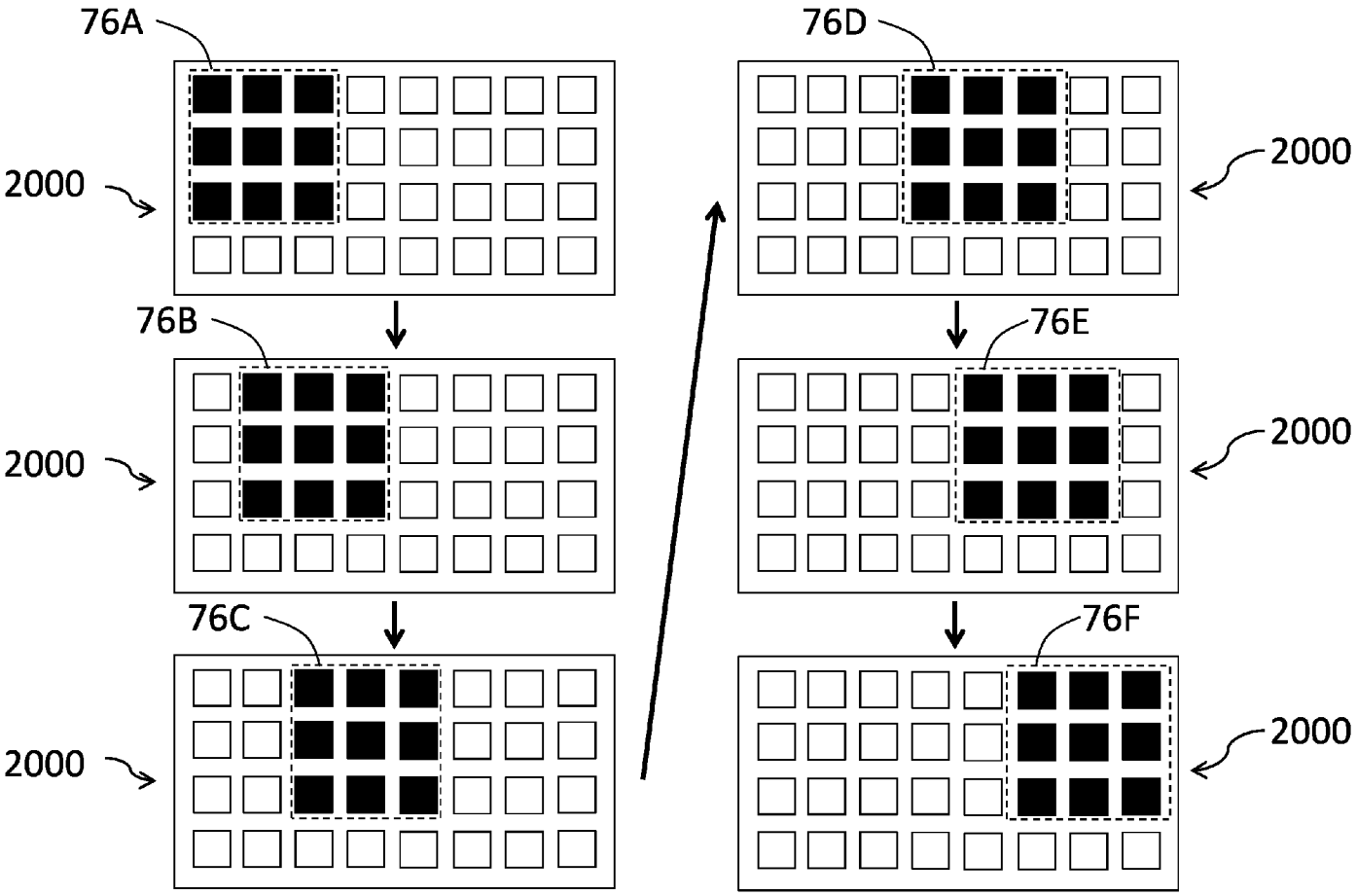
FIG. 14 is a schematic diagram showing the sequential activation of multiple projection modules.

Referring now to FIG. 13, multiple neighboring emitter areas 75 may be grouped as a projection module 76. Although FIG. 14 shows a projection module 76 with 9 (i.e., 3×3) emitter areas 75, it will be appreciated that the projection module 76 can include any number of emitter areas 75, e.g., 10×10 emitter areas 75, 100×100 emitter areas 75, 1000×1000 emitter areas 75, and the like. It will further be appreciated that the projection module 76 is not limited to a square area. The projection module 76 may include a group of emitter areas 75 defining a rectangular area, a circular area, an oval area and the like.

As with individual emitter areas 75, x-rays from projection modules 76 may be emitted in various spatial and temporal patterns.

For example:

With reference to FIG. 14, a series of projection modules 76A-F may be sequentially activated, resulting in a virtual scan, which is equivalent to mechanically moving x-ray source.

Figure 15:
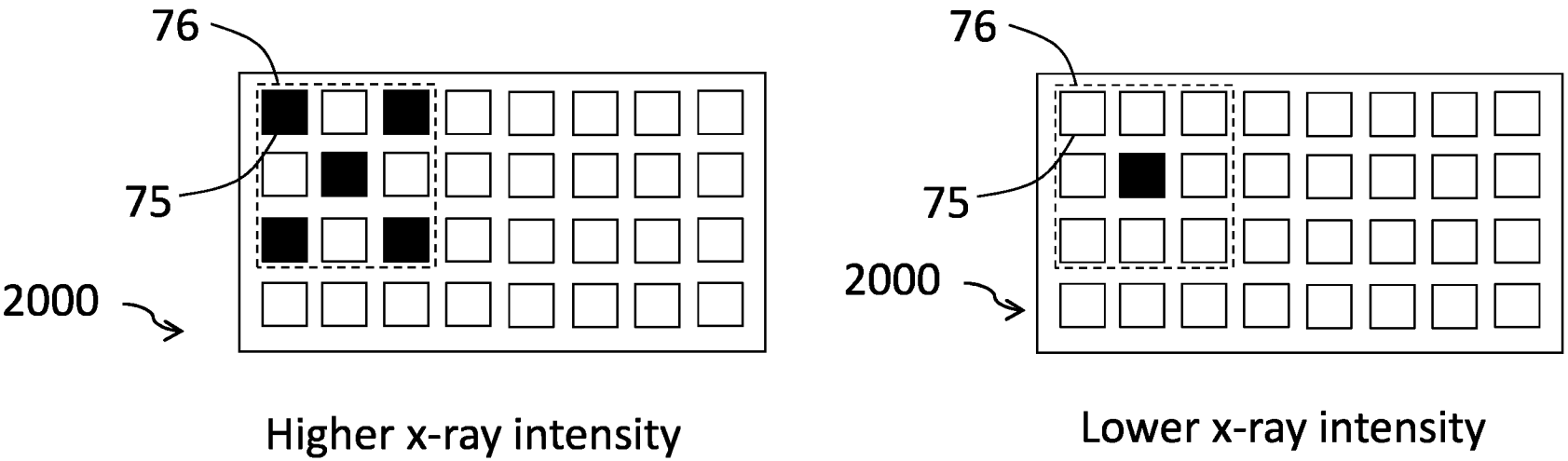
FIG. 15 is a schematic diagram showing the intensity tuning of the x-ray emission of the projection module.

With reference to FIG. 15, the number of emitter areas 75 within the projection module 76 may be adjustable, thus allowing for tuning the intensity of x-rays emitted from the projection module 76. For example, a projection module 76 of nine emitter areas 75 allows for 10 levels of intensity, from every emitter areas being off to all 9 emitter areas being activated. It will be appreciated that a projection module 76 with more emitter areas 75 provides for an even greater range of x-ray emission intensities.

X-Ray Radiography System

Figure 16:
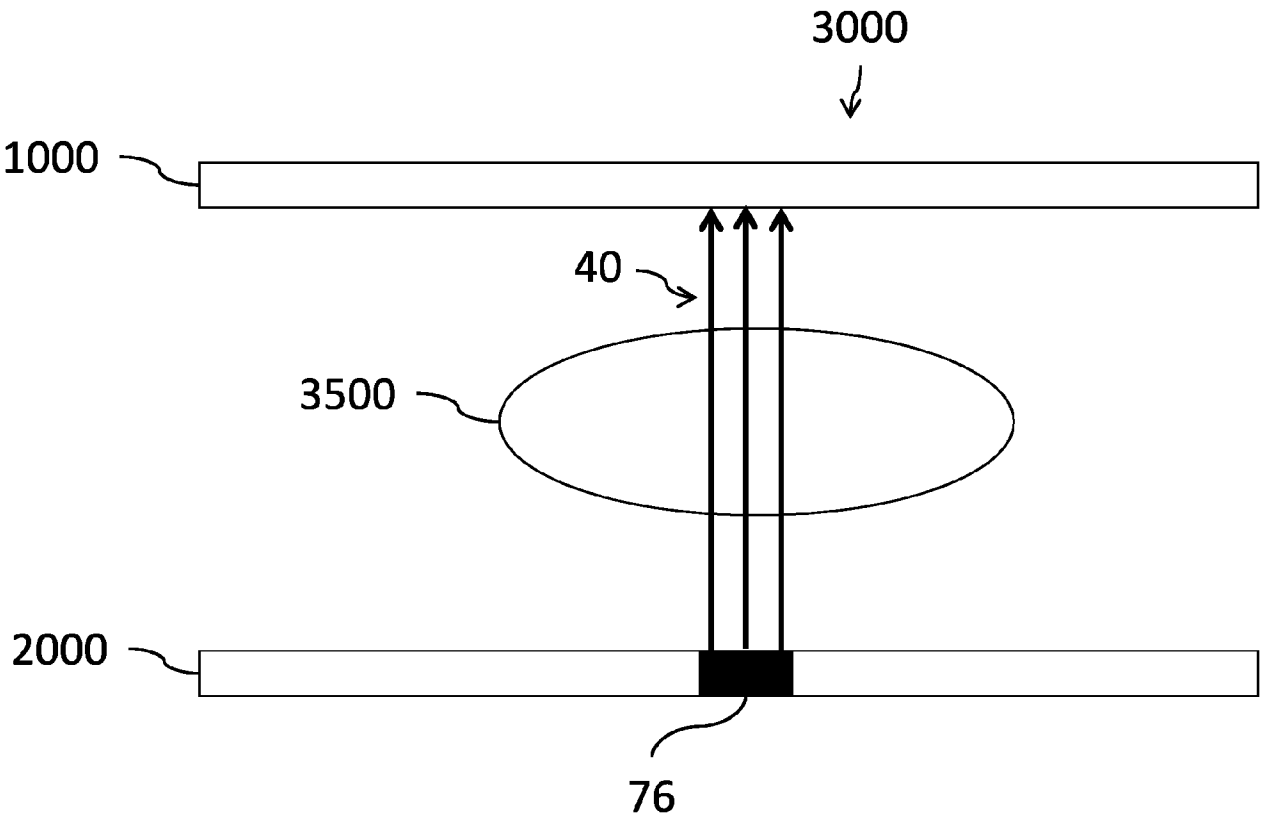
FIG. 16 is a schematic diagram representing an x-ray imaging system according to the present disclosure.

FIG. 16 shows an x-ray radiography system 3000 in which the image capture device 1000 and the x-ray emitting device 2000 are situated facing each other such than object can be placed therebetween to be imaged. The x-rays 40 emitted from a portion of the x-ray emitting device 2000 defined by a projection module 76 and strikes the photoconductor(s) of the image capture device 1000, after at least a portion of the x-rays traverses the object 3500. The x-rays 40 may be parallel, as shown in FIG. 16. Alternatively, the x-rays 40 may have a range of trajectories, resulting in a cone-shape or a fan-shape. The shape of the emitted x-rays may be controlled by, e.g., incorporating a collimator into the x-ray emitting device 2000, as described above.

Figure 17:
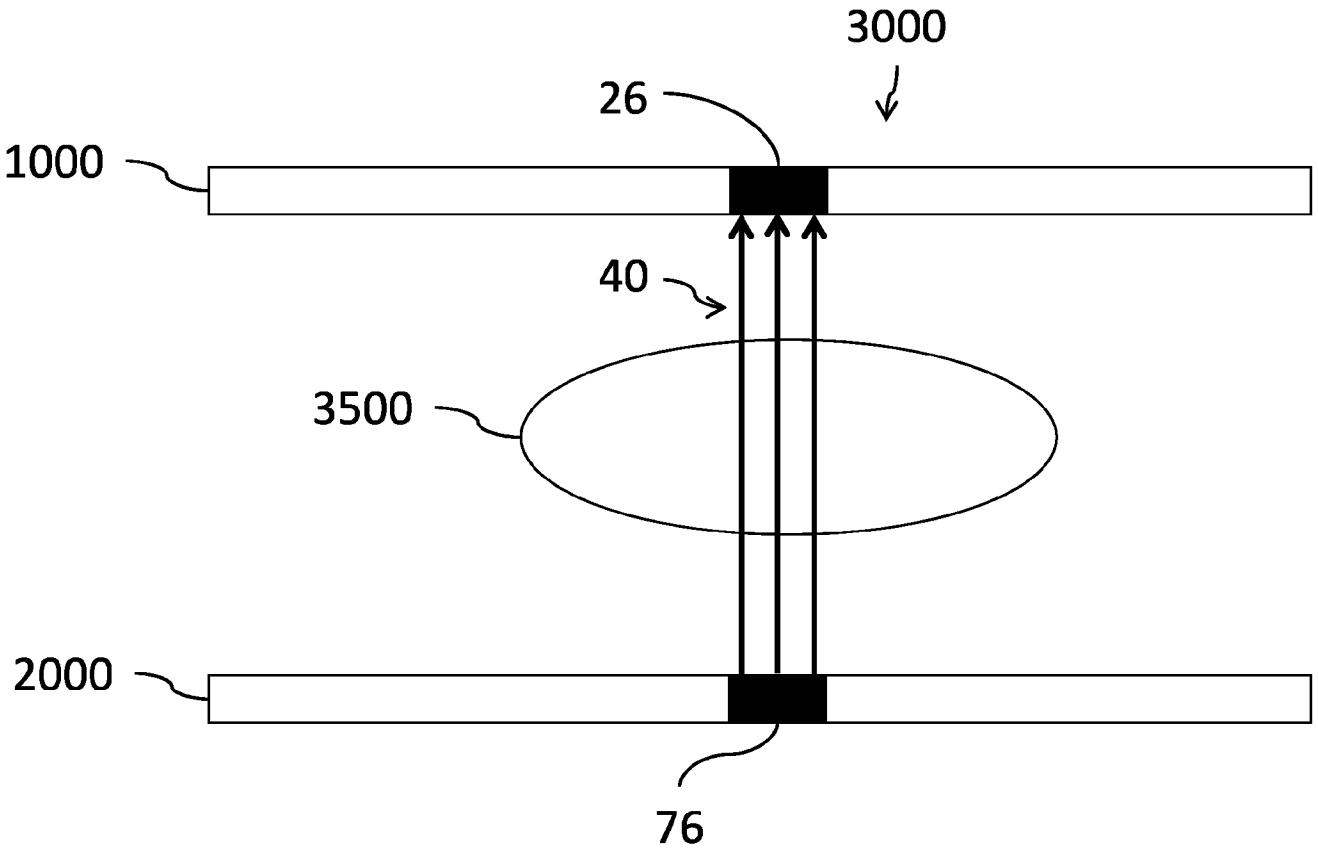
FIG. 17 is a schematic diagram showing the limitation of the scanning of the image capture device limited to a predetermined area defining the capture module.

With reference to FIG. 17, the image capture device 1000 may limit the scanning to emitter areas of a predetermined area defining the capture module 26. Such a limitation may be useful in limiting scanning time and/or in limiting the area of detection to reduce noise by avoiding the detection of scattered electromagnetic waves. This may particularly be the case where the area defined by the projection module 76 in the x-ray emitting device 2000 is restricted, the x-rays 40 is highly collimated resulting in parallel rays. Consequently, the capture module 26 may be restricted to the portion of the image capture 1000 where the non-scattered x-rays 40 emitted from the x-ray emitting device 2000 are expected to strike. That is, the portions of the image capture device not expected to receive the non-scattered x-rays emitted from the x-ray emitting device are inactivated.

Figure 18:
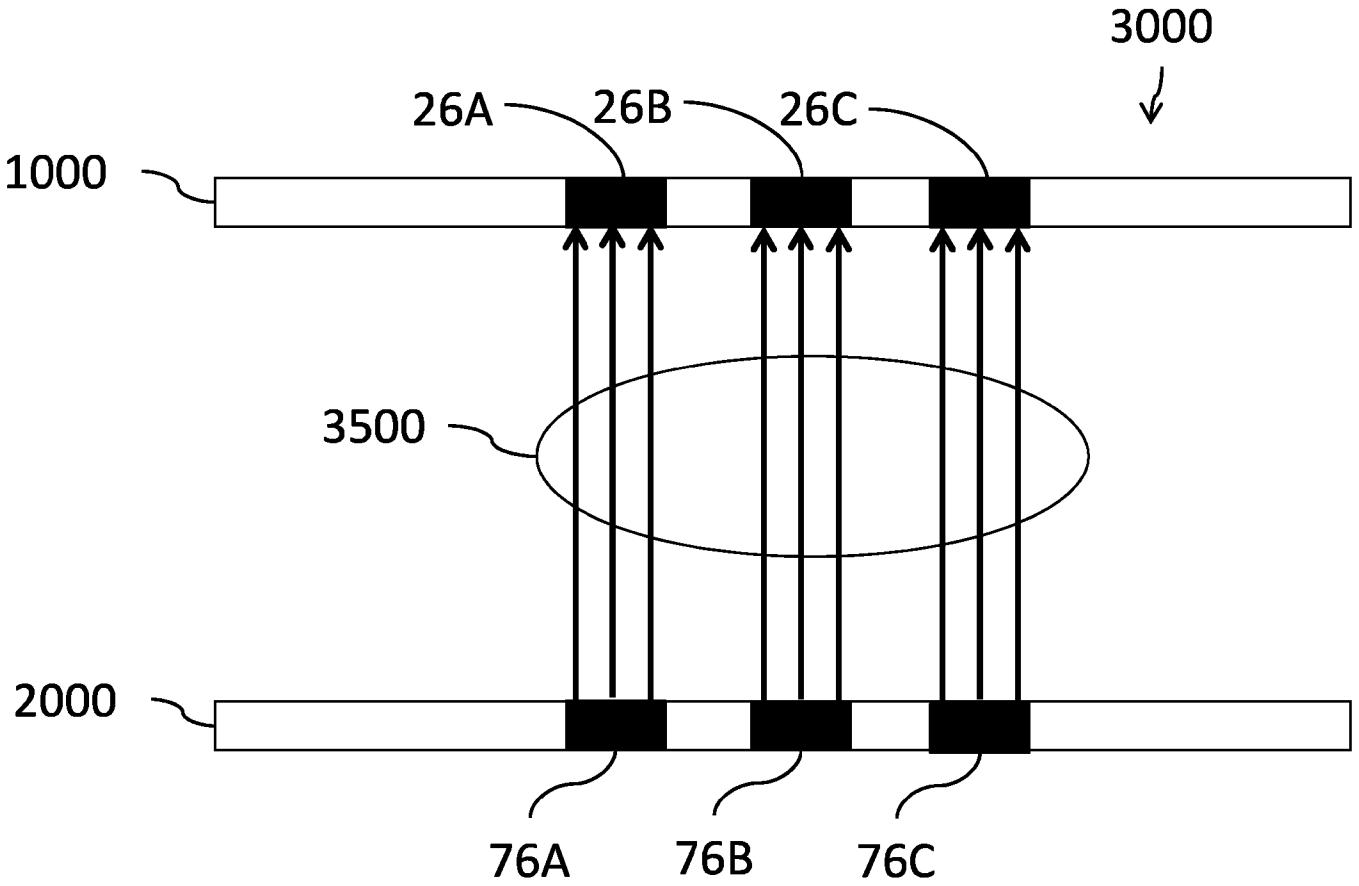
FIG. 18 is a schematic diagram showing the synchronous serial activation of the projection module of the x-ray emitting device and its corresponding capture module of the image capture device.

With reference to FIG. 18, is the region of interest within the object 3500 cannot be fully imaged within the x-rays emitted from the projection module 76, then the projection module 76 may be scanned. That is, multiple projection modules (e.g., 76A-C) may be activated serially to cover a larger area over time. In addition, capture modules (26A-C) may be synchronized with the projection modules 76A-C, such that only the portion of the image capture device 1000 expected to be struck by the non-scattered x-rays from the corresponding projection module 76 is capable of detecting x-rays. It will be appreciated that the activation of multiple projection modules do not require any mechanical movements, thus allowing images to be produced at a high rate. This in turn allows for dynamic x-ray imaging.

Figure 19:
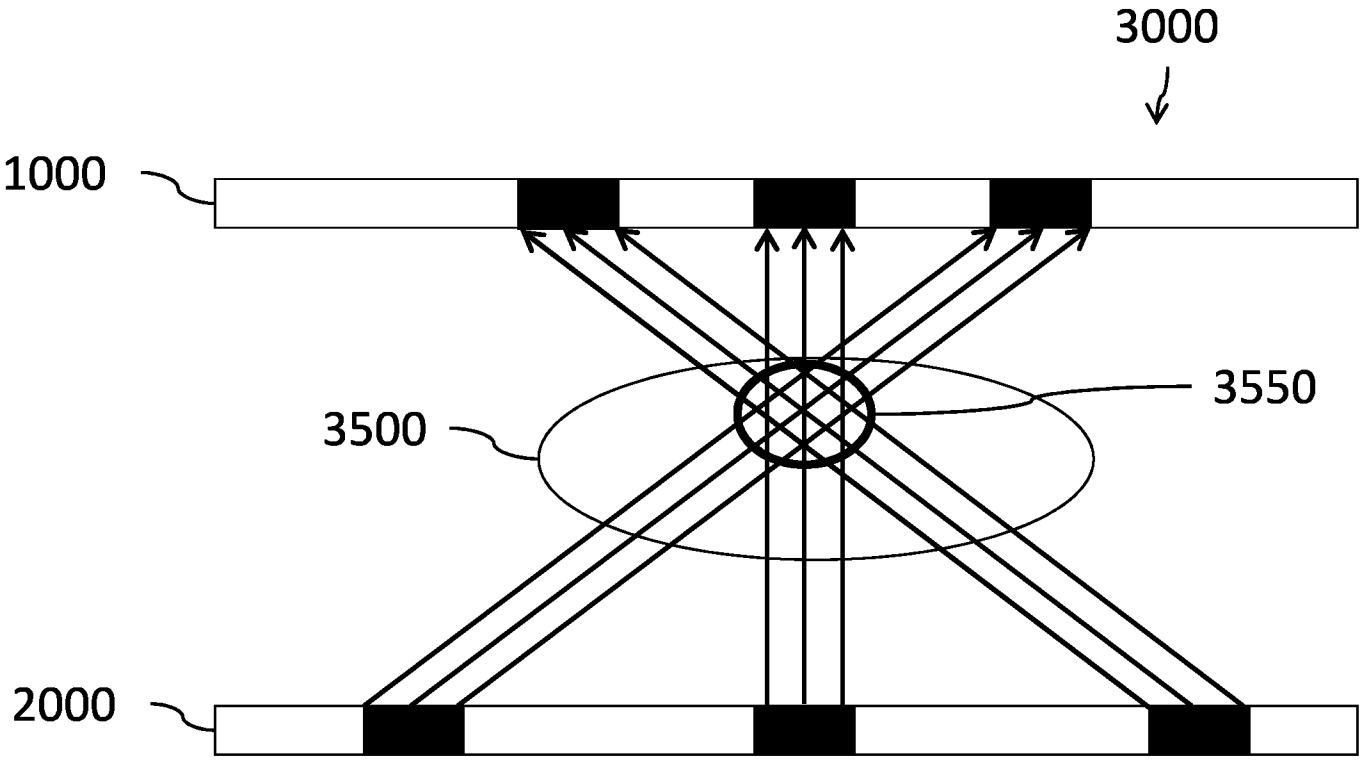
FIG. 19 is a schematic diagram showing, in a tomography system, the synchronous serial activation of the projection module of the x-ray emitting device and its corresponding capture module of the image capture device.

With reference to FIG. 19, the use of multiple projection modules 76A-C synchronized with corresponding capture modules 26A-C may be applied to a tomographic system, where a region of interest 3550 within the object 3500 is imaged from x-rays striking the region of interest at various angles. It will be appreciated that the activation of multiple projection modules do not require any mechanical movements, thus allowing tomographic images to be produced at a high rate. This in turn allows for dynamic tomographic x-ray imaging. As such, the system 3000 may be incorporated into an improved computerized tomography system, for example but not limited to: an electron beam computerized tomography (E-beam CT, EBCT) system or acone beam computerized tomography (CBCT) system.

Figure 20A:
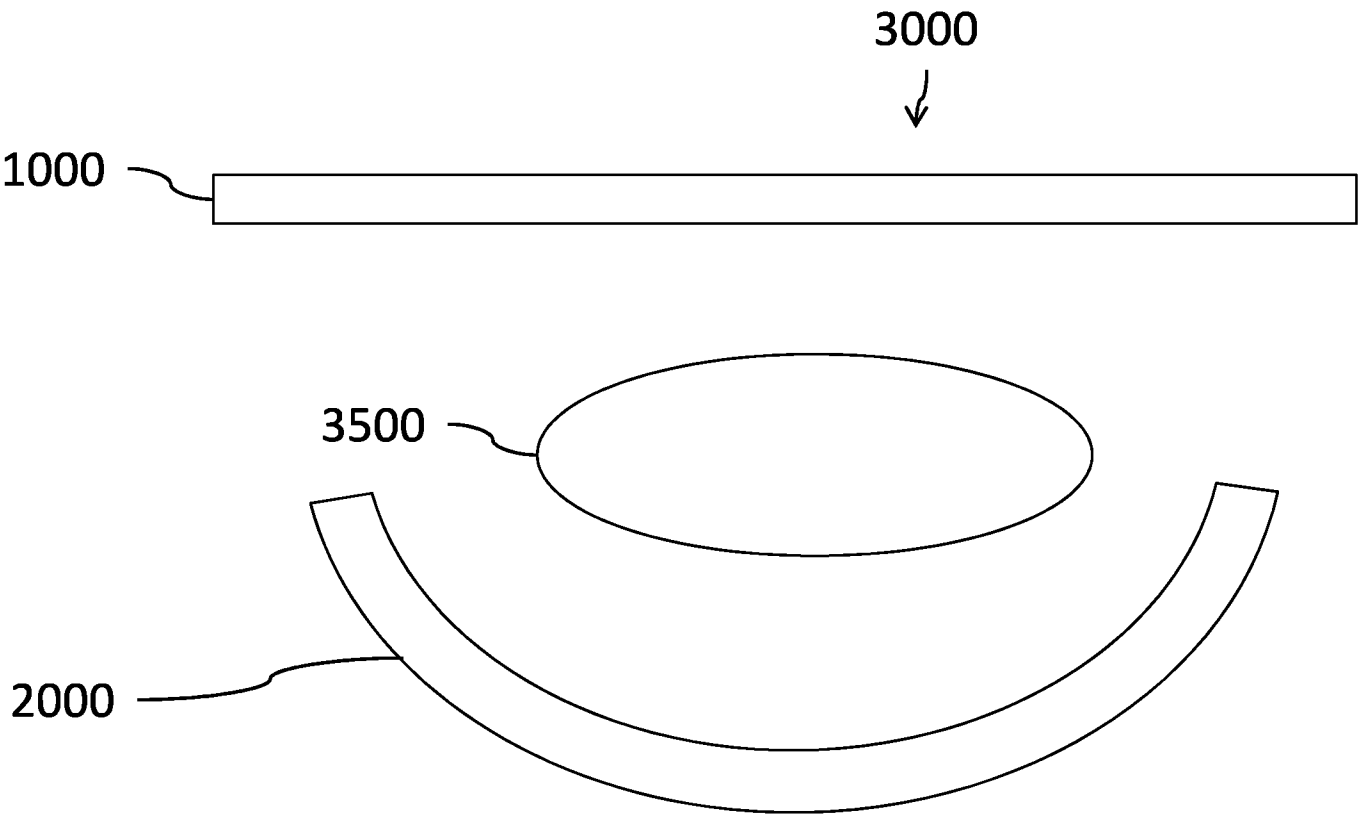
FIGS. 20A-C are schematic diagrams of an x-ray imaging system with a combination of flat or curved x-ray emitting devices and/or image capture device.
Figure 20B:
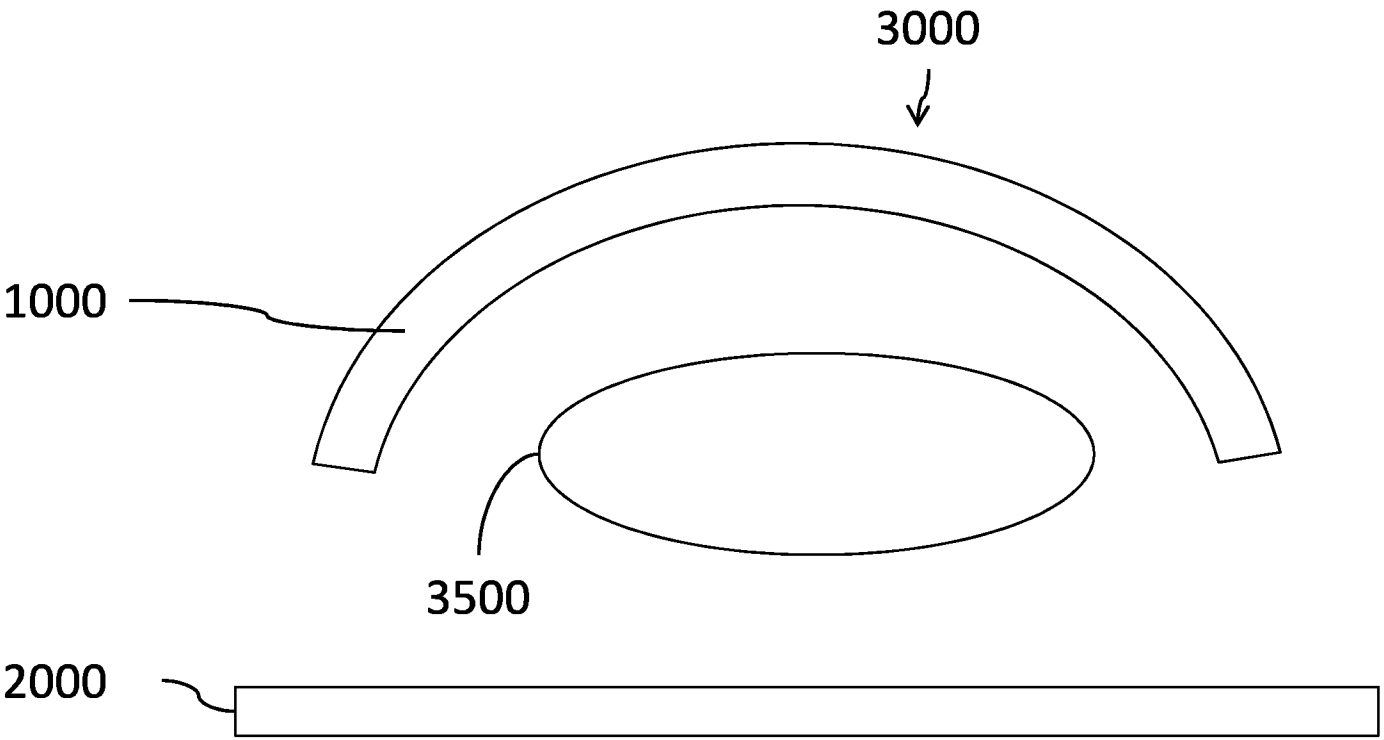
Figure 20C:
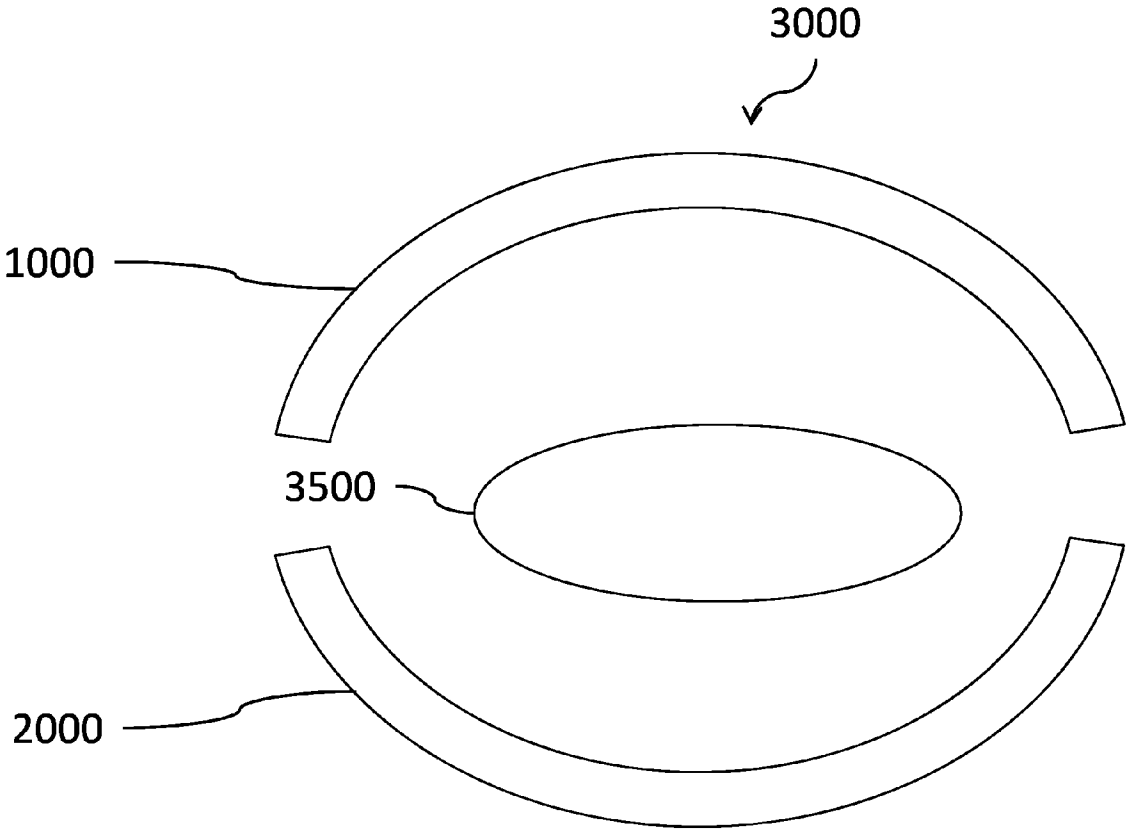

With reference for FIGS. 20A-B, although FIGS. 16-19 show the image capture device 1000 and the x-ray emission device 2000 as a flat strip or surface, it will be appreciated that the image capture device 100 and/or the x-ray emission device 2000 may have a curved shape, e.g., having the cross-section of be an arc or a semi-circle. FIG. 20A shows a system 3000 with a flat image capture device 1000 and a curved x-ray emission device 2000. FIG. 20B shows a system 3000 with a curved image capture device 1000 and a flat x-ray emission device 2000. FIG. 20C shows a system 3000 with a curved image capture device 1000 and a curved x-ray emission device 2000.

X-Ray Emitting Device for Emitting X-Rays at Different Energies

In the x-ray emitting device of the disclosure, individual emitter areas may be configured to emit x-rays at a defined energy (keV). All of the emitter areas may be configured to emit x-rays of the same energy. Alternatively, the emitter areas may be configured to emit x-rays with different energies. For example, the x-ray emitting device may have a regular arrangement of emitter areas configured to emit x-rays at low, medium and high keV's, each group of emitter areas configured to emit x-rays at a particular energy being an energy channel. Each energy channel may be activated at sequentially different times, so that the low keV source gives off its x-rays at time=0. Following this, the medium KeV x-rays are given off (at, e.g., time=16 milliseconds), followed by the high KeV x-rays 16 ms later (at time=32 milliseconds). Thus within 50 milliseconds, three different KeV images are made and these can be combined algorithmically to distinguish between different types of tissues.

Examples

Simulation of the Effect of Focus Structures

Figure 21:
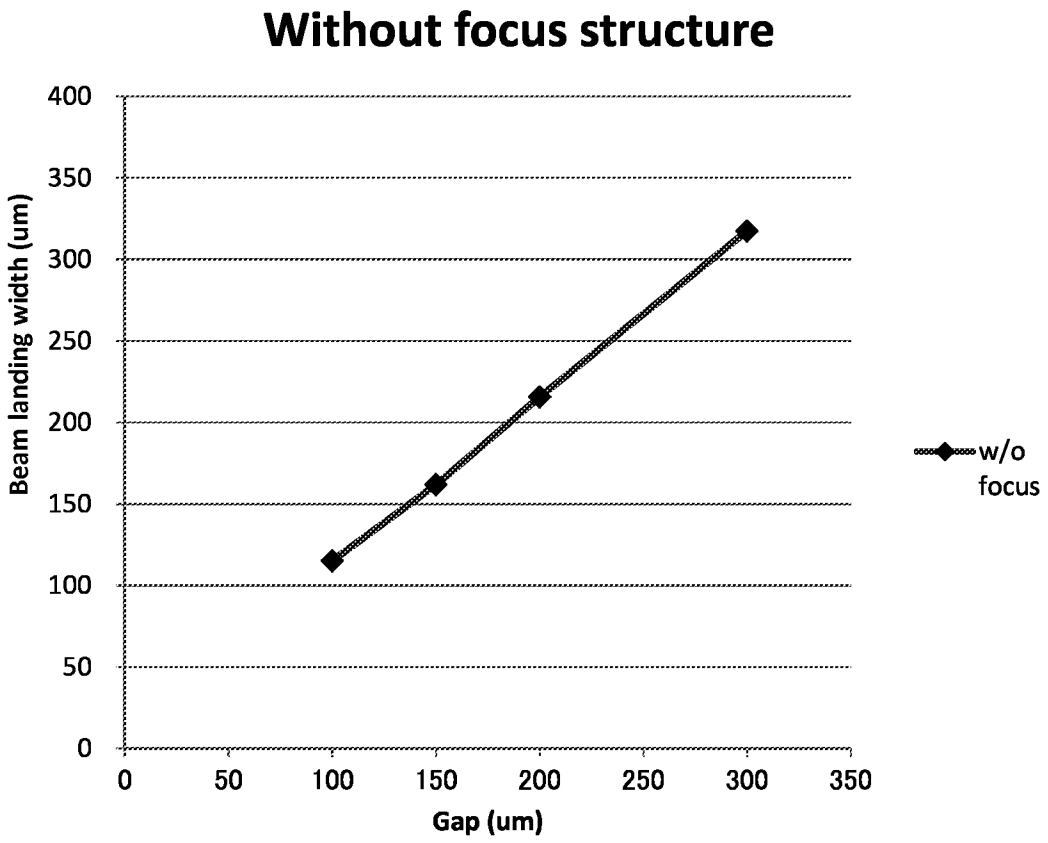
FIG. 21 shows the results of a simulation showing the effect of the width of the distance between the electron emitting construct and the electron receiving construct (Gap) on the width of the area on the photoconductor that is struck by the electron beam from the electron sources of an emitter area (beam landing width).

FIG. 21 shows the results of a simulation depicting how the width of an electron beam, at the point where it strikes a photoconductor facing it (i.e., the beam landing width), increases as the gap between the electron emitting construct and the electron receiving construct increases. With reference to FIG. 21 (as well as FIGS. 22 and 24), the beam landing width refers to the width of an electron beam at the point where it strikes a photoconductor facing it, and the gap refers to the distance between the anode (on the electron receiving construct) and the cathode (on the electron emitting construct).

It is desirable that the beam landing width is not more than the pixel pitch, so that the electron beam emitted from one emitter area does not overlap with the electron beam emitted from an adjacent emitter area. Given the widening of the beam landing width with gap distance, the pixel pitch that can be achieved within a certain gap distance is limited. The focus structures/electrodes serve to restrict the widening of the beam landing width with gap distance, thus enabling smaller pixel pitch with a larger gap (e.g., between anode and cathode).

Figure 22:
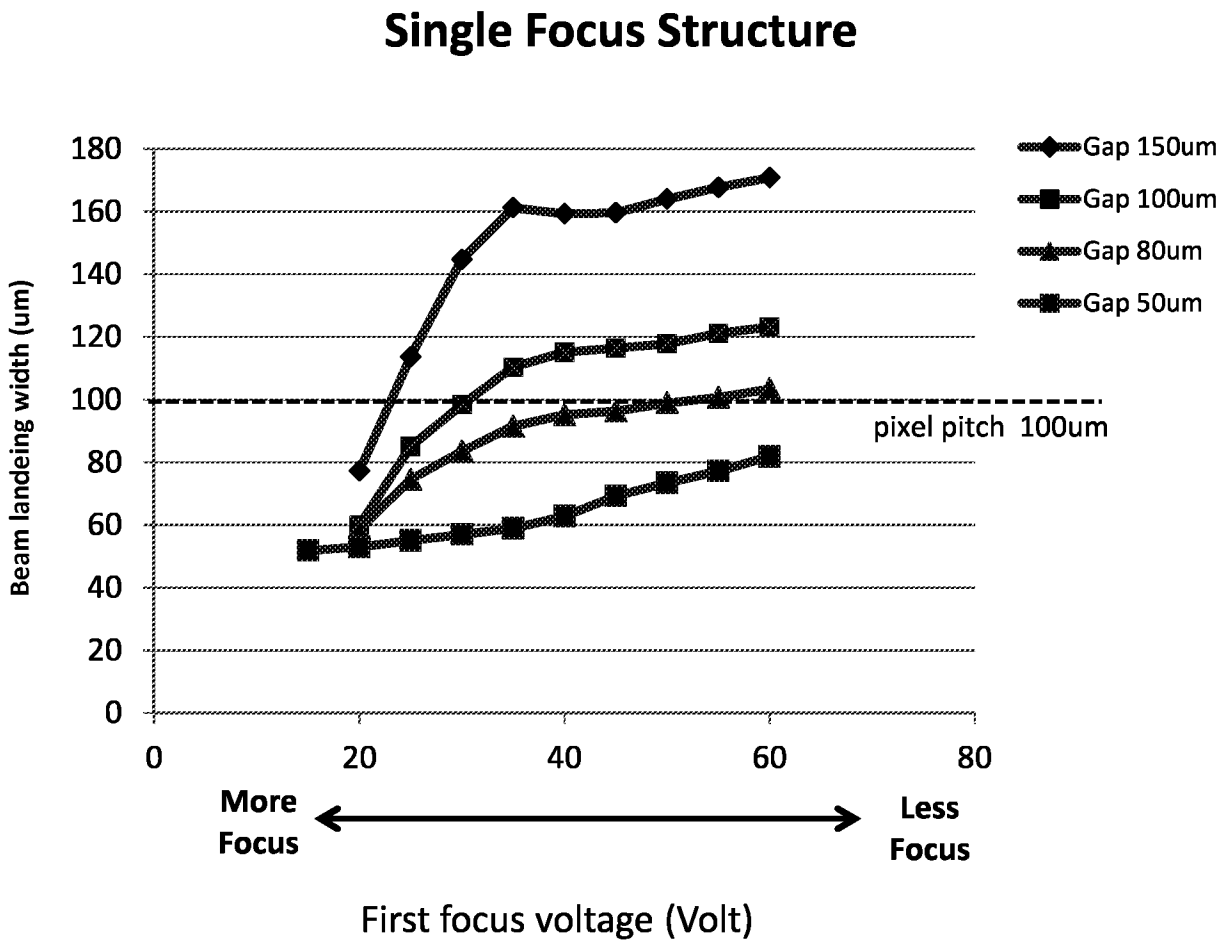
FIG. 22 shows the results of a simulation showing the effect of a single focus structure on electron beam trajectory.

With reference to FIG. 22, the presence of a first focus structure and the application of a first focus voltage across a first focus electrode may restrict the beam landing width. For example, in a simulated image capture device comprising a single focus structure with a gap (anode to cathode) of 100 micrometers, the beam landing width was restricted to about 100 micrometers, in order to match the target pixel pitch of 100 micrometers, with the application of about 30 volts to the first focus electrode (cathode basis). With a gap of 150 micrometers, the beam landing width was restricted to about 100 micrometers with the application of about 22.5 volts (between 20 and 25 volts) to the first focus electrode. The optimal first focus voltage depends on the size of the gap (e.g., anode to cathode distance), as is shown in FIG. 22, as well as with other of parameters including the specifications of the field emission type electron source, the dimensions of the focus structure, and other parameters of the device, which may be adjusted as needed. The results of the single focus simulation are shown below in Table 1.

TABLE 1

Beam Landing Width (in micrometers) with single focus

| Gap (micrometers) | 1st Focus Voltage 20 volts | 40 volts | 60 volts |
|---|---|---|---|
| 50 | 53 | 62.8 | 81.8 |
| 80 | 58.7 | 95.1 | 103.4 |
| 100 | 59.8 | 115.1 | 123.2 |
| 150 | 77.3 | 159.3 | 170.8 |

Further simulated experiments show the role of the first focus structure in affecting electron beam landing width. Table 2 shows the 5% beam width with a cathode-anode gap of 3 millimeters (mm), 4 mm or 5 mm; a focus voltage of 0 volts (V), 100 V or 200 V, and an anode voltage of 10000 V, 20000 V, 30000 V, 40000 V or 50000 V.

TABLE 2

5% beam landing width (in micrometers) with single electrode

| Cathode-Anode Gap | | Focus Voltage (Volt) | Anode Voltage (Volt) 10000 | 20000 | 30000 | 40000 | 50000 |
|---|---|---|---|---|---|---|---|
| gap 3 mm | Ef | 0 | 310.2 | 214.3 | 184.1 | 178.8 | 175.6 |
| | | 100 | 213.7 | 144.8 | 130.0 | 123.5 | 123.3 |
| | | 200 | 302.6 | 164.1 | 118.5 | 107.2 | 101.8 |
| gap 4 mm | Ef | 0 | 318.8 | 287.3 | 237.2 | 218.8 | 214.0 |
| | | 100 | 305.5 | 188.2 | 160.9 | 152.2 | 145.4 |
| | | 200 | 425.1 | 242.9 | 172.3 | 137.1 | 127.9 |

TABLE 2-continued

5% beam landing width (in micrometers) with single electrode

| Cathode-Anode Gap | | Focus Voltage (Volt) | Anode Voltage (Volt) 10000 | 20000 | 30000 | 40000 | 50000 |
|---|---|---|---|---|---|---|---|
| gap 5 mm | Ef | 0 | 285.7 | 386.1 | 291.2 | 257.6 | 254.5 |
| | | 100 | 410.4 | 237.7 | 197.6 | 177.6 | 171.0 |
| | | 200 | 494.1 | 340.5 | 234.0 | 181.0 | 153.1 |

Figure 23B:
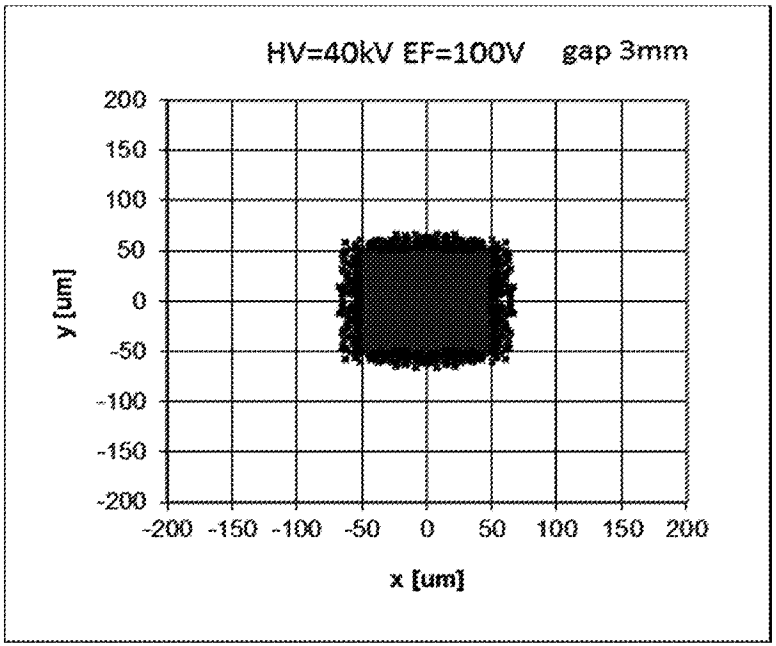
FIG. 23 is a graphical representation of a simulation showing the effect of a single focus structure on electron beam trajectory.
Figure 23A:
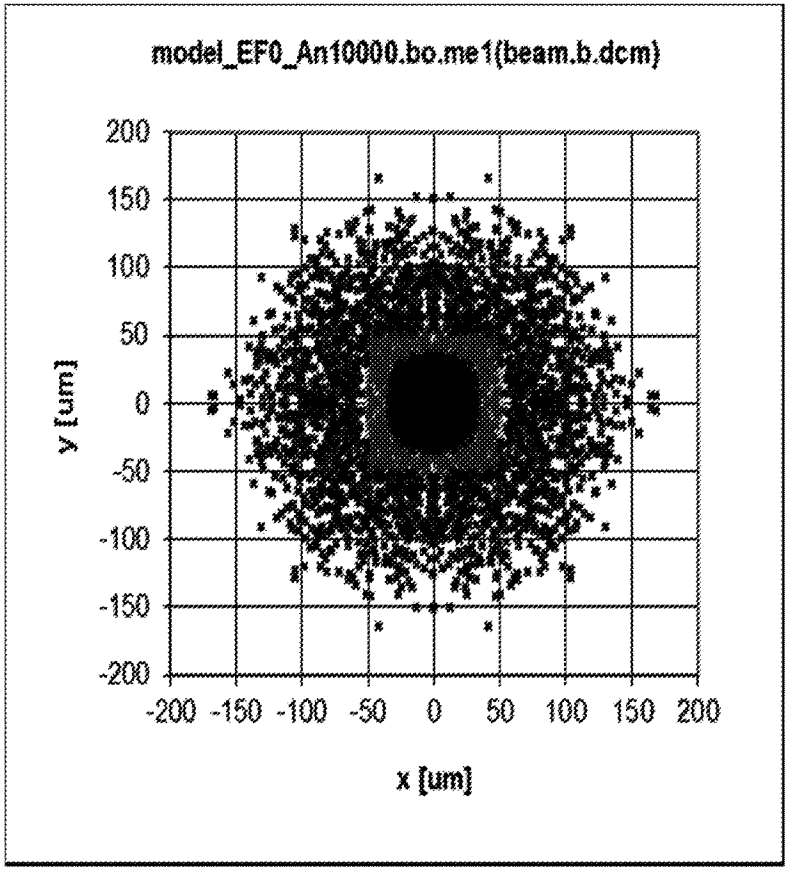

FIG. 23A shows the simulated beam landing width of an electron emitting construct having a cathode-anode gap of 5 mm, no focus voltage, and an anode voltage of 10000 V. FIG. 23B shows the simulated beam landing width of an electron emitting construct having a cathode-anode gap of 3 mm, a focus voltage of 100 V, and an anode voltage of 40000 V.

Figure 24:
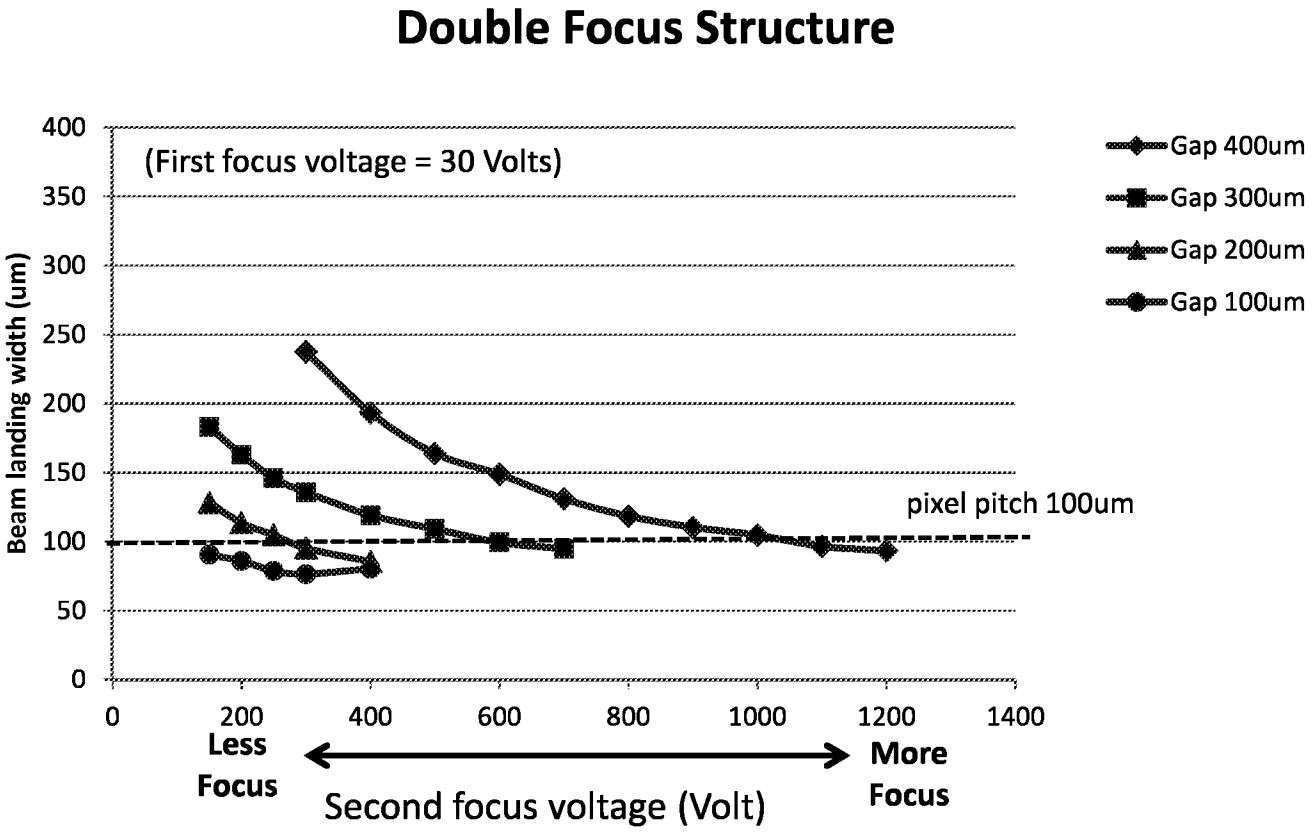
FIG. 24 shows the results of a simulation showing the effect of a double focus structure on electron beam trajectory.

With reference to FIG. 24, the further presence of a second focus structure in combination with the first focus structure (i.e., a double focus) may further restrict the beam landing width. For example, in a simulated image capture device comprising a double focus structure with a gap (anode to cathode) of 300 micrometers, the beam landing width was restricted to about 100 micrometers, in order to match the target pixel pitch of 100 micrometers, with the application of about 600 volts to the second focus electrode (cathode basis) in combination with the application of 30 volts to the first focus electrode (cathode basis). With a gap of 400 micrometers, the beam landing width was restricted to about 100 micrometers with the application of about 1000 volts to the second focus electrode in combination with the application of 30 volts to the first focus electrode. The optimal second focus voltage depends on the size of the gap (e.g., anode to cathode distance), as is shown in FIG. 24, as well as with other of parameters including the specifications of the field emission type electron source, the dimensions of the focus structure, and other parameters of the device, which may be adjusted as needed. The results of the double focus simulation are shown below in Table 3.

TABLE 3

Beam Landing Width (in micrometers) with double focus

| Gap (micrometers) | 2nd Focus Voltage 200 volts | 400 volts | 600 volts | 800 volts | 1000 volts |
|---|---|---|---|---|---|
| 100 | 85.9 | 80.4 | | | |
| 200 | 113.5 | 85.5 | | | |
| 300 | 162.9 | 119.1 | 99.4 | | |
| 400 | | 193.3 | 148.7 | 118.5 | 104.7 |

(First focus voltage = 30 volts)

Figure 25A:
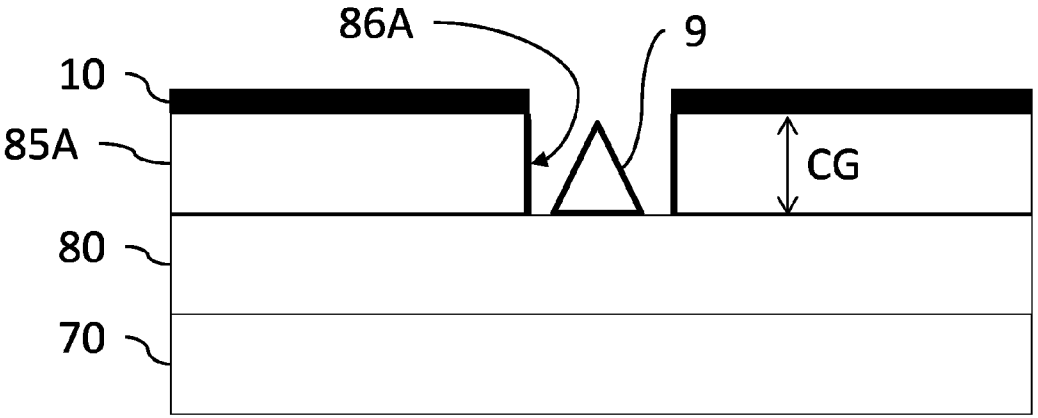
FIGS. 25A-C are schematic representations of electron emitting constructs comprising gate electrode support structures for use in various embodiments of image capture devices or x-ray emitting devices of the disclosure.

Reference is now made to FIG. 25A showing a schematic representations of a section of an electron emitting construct for use in an image capture device, or an x-ray emitting device of the disclosure. The electron emitting construct includes a cathode 70, a plurality of field emission type electron sources 9 (only one illustrated for clarity), a resistive layer 80 a gate electrode 10 and gate electrode support structure 85A. It is noted that the electron emitting construct may further include a backplate and substrate such as described herein above.

It is noted that the gate electrode support structure 85 is provided to support the gate electrode 10 at a required cathode-gate spacing CG. The cathode-gate spacing CG may be selected such that the electric field between the cathode and the gate electrode is suitable for emission of electrons from the field emission type electron source 9 with a required acceleration. For example the cathode-gate spacing may be approximately 200 nanometers or so. Alternatively, the cathode-gate spacing may be between 200 and 500 nanometers or more, or between 100 nanometers and 200 nanometers or less as required.

It is noted that the gate electrode support may further prevent current leakage or discharge between the gate electrode 10 and the cathode 70. Direct discharge between the cathode 70 and the gate electrode 10 may be prevented or at least limited through the introduction of a resistive interlayer 85A configured to have regular gaps or apertures at the electron sources 9.

Nevertheless, current leakage, or creeping, may still occur, particularly along the surface path 86A adjacent to the electron source aperture. Accordingly various embodiments of the interlayer may be configured to increase the creeping distance so as to increase the resistance path along the surface.

Figure 25B:
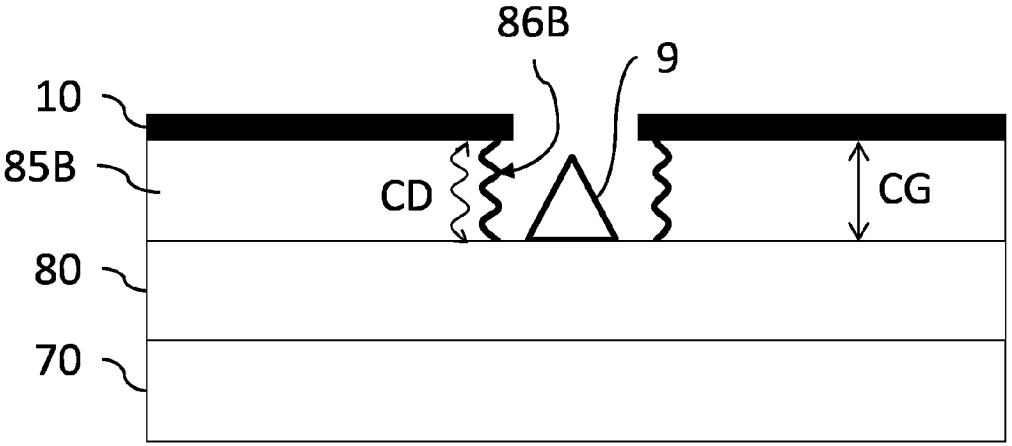

Referring now to FIG. 25B a second embodiment of the gate electrode support structure 85B for use in an image capture device, or an x-ray emitting device of the disclosure is schematically represented. It is noted that the surface path 86B of the gate electrode of the second embodiment 85B has an undulating profile including alternate convex and concave sections. Accordingly, the creeping distance CD between said cathode 80 and said gate electrode 10 is greater than said cathode-gate spacing CG.

Figure 25C:
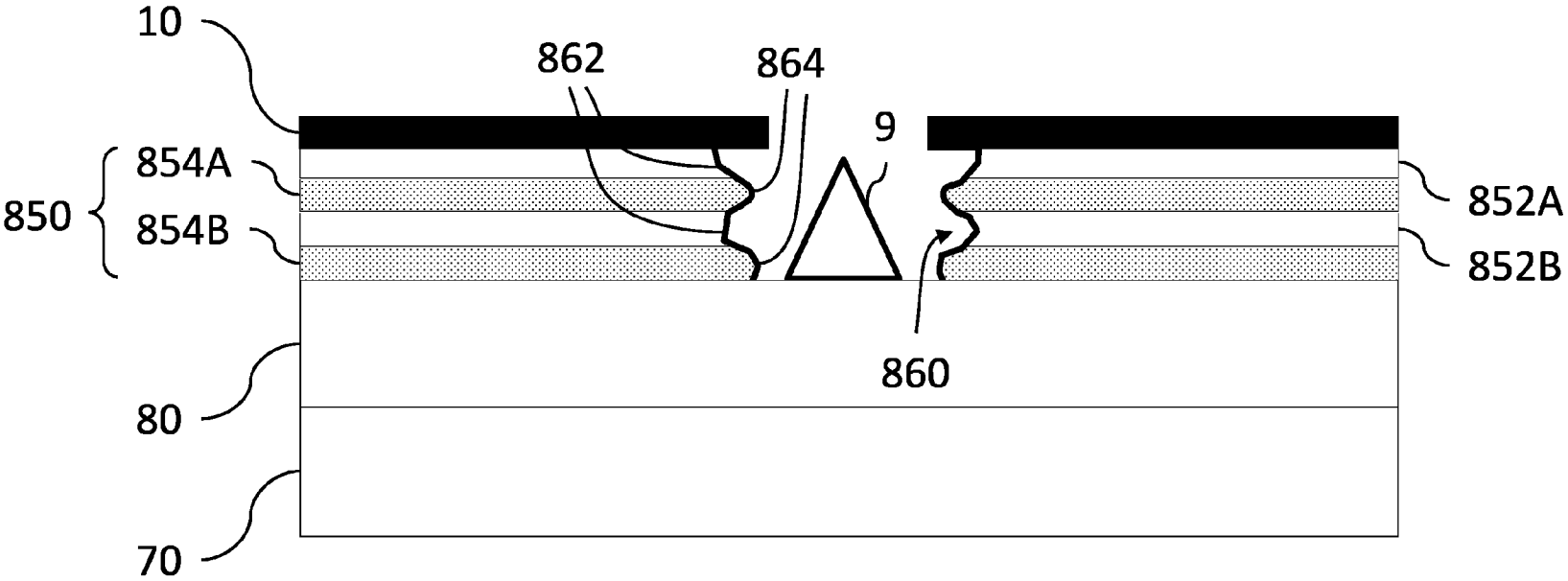

Referring now to FIG. 25C still a further embodiment of an electron emitting construct for use in an image capture device, or an x-ray emitting device of the disclosure is presented which includes a stratified interlayer 850. The stratified interlayer 850 may be configured to produce undulating surface path 860 such as described above.

The stratified interlayer 850 includes at least one stratum 852A, 852B (collectively 852) of a readily etchable material and at least a one stratum of a second less readily etchable material 854A, 854B (collectively 854). Accordingly, when the electron source aperture is etched out of the stratified interlayer 850, the etched surface of the readily etchable material 852 forms concave sections 862 of the surface path 860 whereas the etched surface of the less readily etchable material 854 forms convex sections 864 of the surface path 860, thereby forming the undulating surface path 860 as required.

Various materials may be selected for their corrosive or etchability properties. For example the readily etchable strata 852 may be constructed from a low density material, such as low density silicon dioxide or the like, and the less readily etchable strata 854 may be constructed from a higher density material such as higher density silicon dioxide, silicon oxynitride, silicon nitride or the like. Other combinations of readily etchable materials and less readily etchable materials will occur to those skilled in the art. The selection may vary according to the corrosiveness of the etching agents.

Figure 26A:
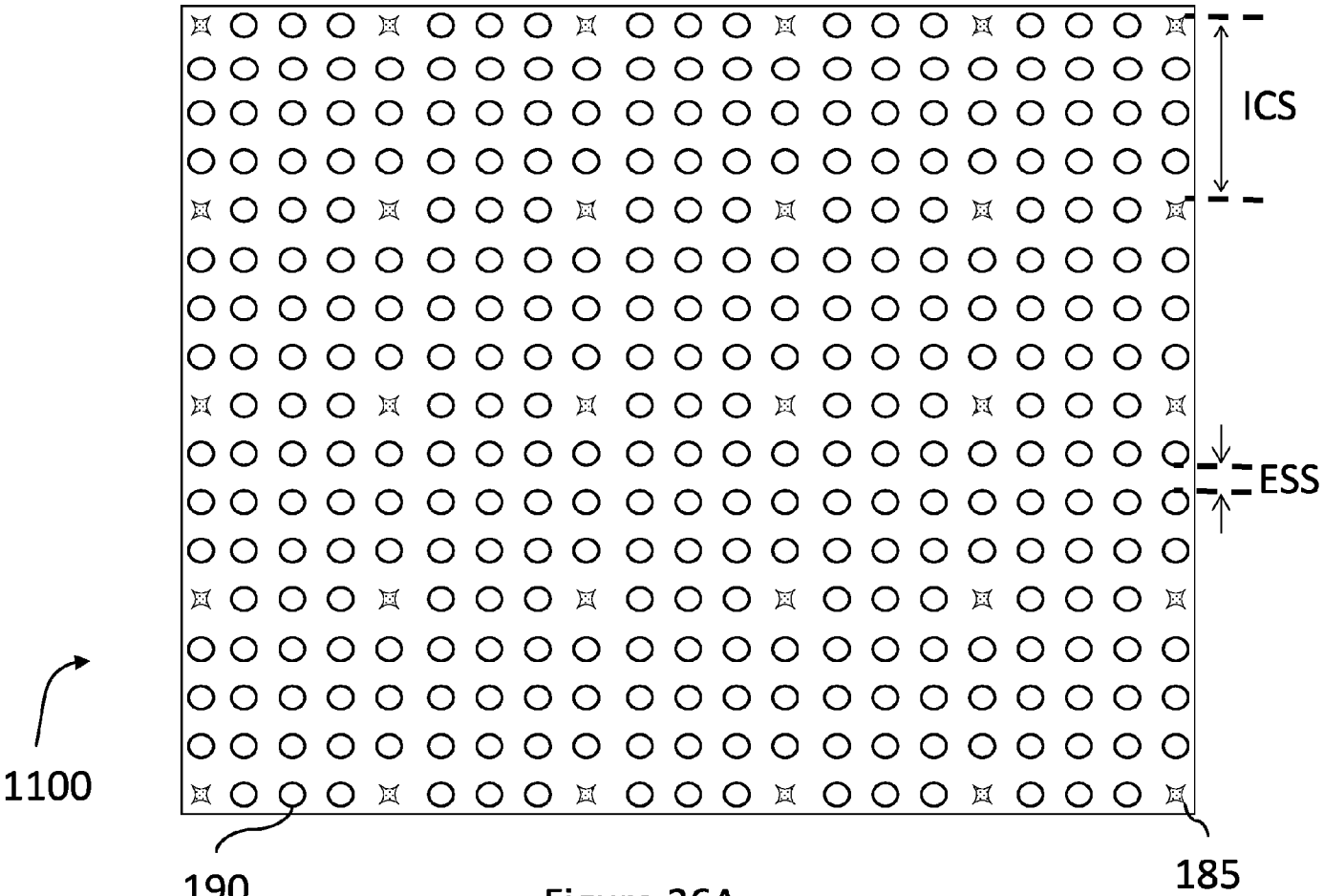
FIG. 26A is a schematic top view representation of a section of an embodiment of an electron emitting construct and illustrating the array configurations of the field emission type electron sources and the gate electrode support columns for use in various embodiments of image capture devices or x-ray emitting devices of the disclosure.

Referring now to FIG. 26A a schematic top view is presented illustrating a section of an embodiment of an electron emitting construct 1100 for use in an image capture device, or an x-ray emitting device of the disclosure comprising an array of the field emission type electron sources 190. The emission type electron sources 190 are arranged in an array having a regular electron source spacing ESS. It is noted particularly that rather than an interlayer extending over the whole electron emitting construct 1100 with electron source apertures etched thereinto the gate support structure of this embodiment comprises an array of gate electrode support columns 185.

The gate electrode support columns 185 may also be arranged in an array with a regular inter-column spacing ICS. The inter-column spacing ICS may be larger than the regular electron source spacing ESS, thereby reducing the number leakage paths available for creeping current. Where required, the support columns 185 may be provided in place of missing electron sources at regular intervals.

Figure 26B:
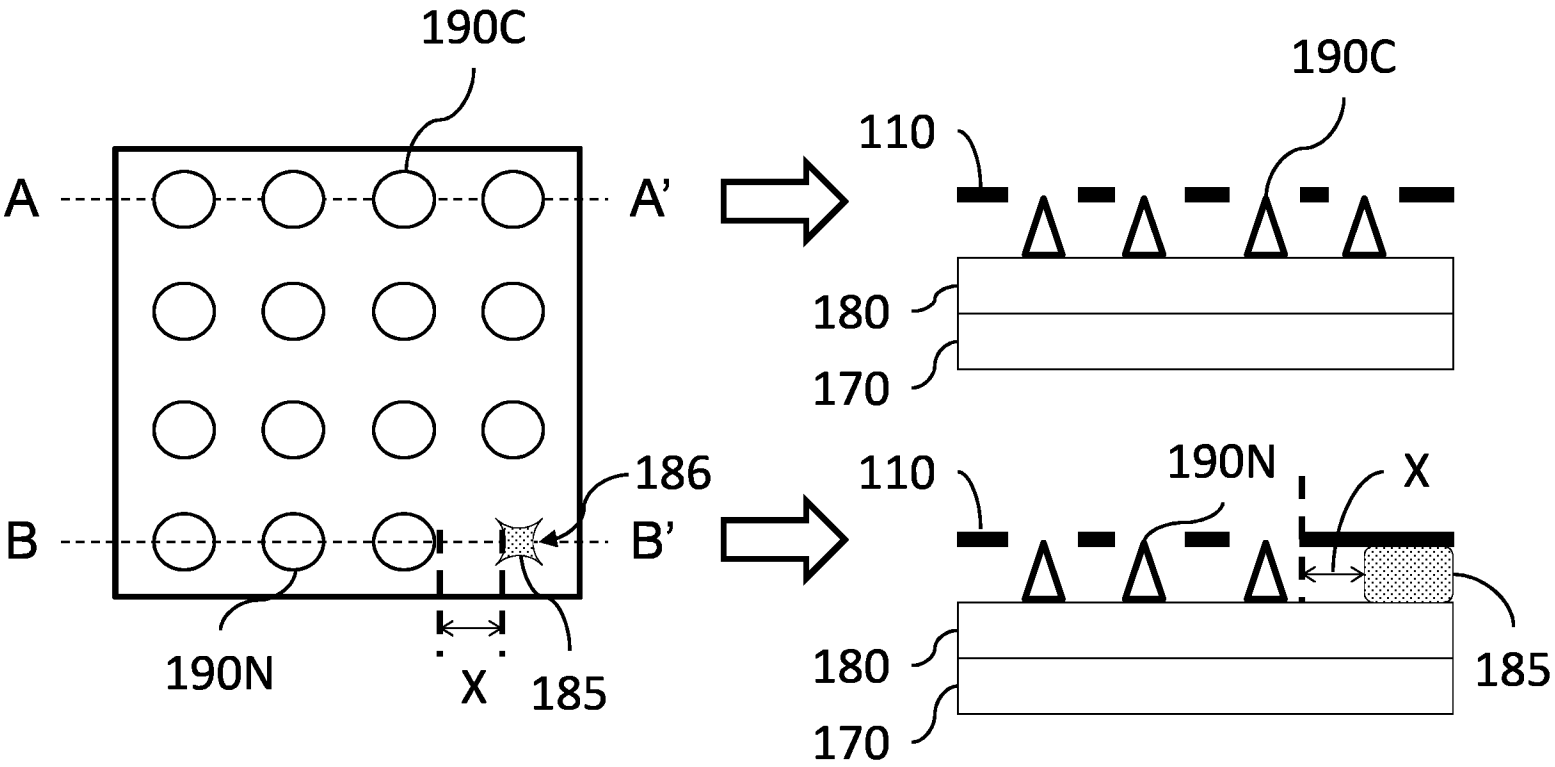
FIG. 26B schematically represents two sections through the electron emitting construct of the embodiment of FIG. 26A.

Referring now to FIG. 26B, two sections through the electron emitting construct of the embodiment of FIG. 26A are schematically represented. A four by four square is represented including fifteen electron sources 190A-O (only 190C and 190N labeled) and one support column 185 occupying the position of a missing sixteenth electron source.

A first cross section A-A' is shown along a row of four electron sources 190 upon a resistive layer 180 and a cathode 170. The first cross section A-A' illustrates how the gate electrode 110 may be supported by its own structural strength with no interlayer at all between the gate electrode 110 and the resistive layer 180. The second cross section B-B' illustrates how the gate electrode 110 is periodically supported by support columns 185. Accordingly, the gate electrode 110 may be constructed from materials for example chromium or the like selected for their required mechanical properties, such as tensile strength and density.

It is further noted that the column profile may include concave sides 186. This profile may allow the distance X between each said support column 185 and its nearest neighboring electron sources to be greater than said electron source spacing ESS, thereby further reducing discharge and current leakage.

Figure 27A:
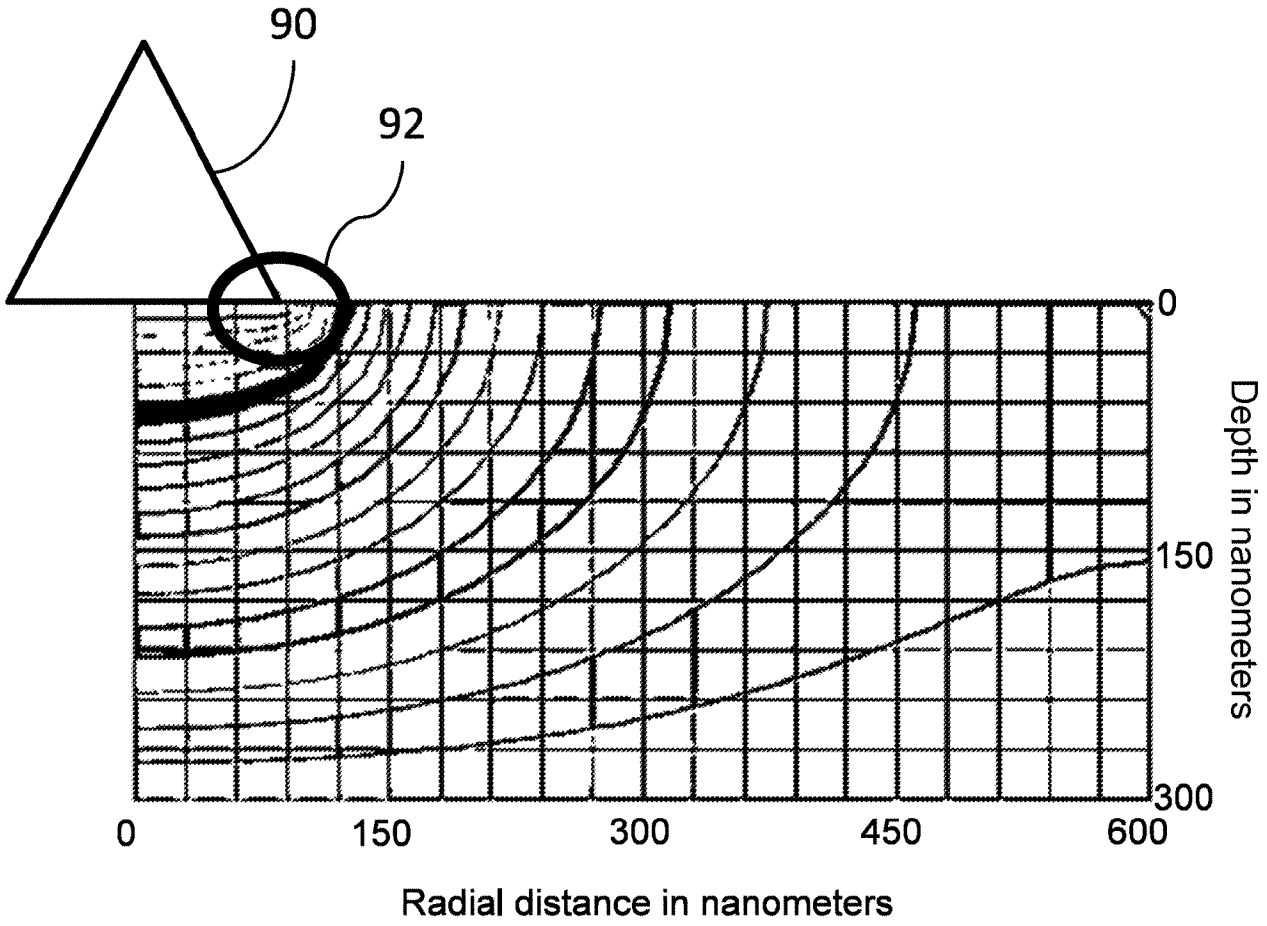
FIG. 27A shows a graphic illustration of the potential distribution through a resistive layer having a constant resistivity.

Reference is now made to FIG. 27A which shows a graphic illustration of the potential distribution under an electron source, such as a Spindt type electron source 90 for example, through a resistive layer having a constant resistivity. It is noted that the potential gradient directly beneath the tip is particularly steep. Accordingly, there is an associated high current density in the region beneath the tip and particularly at the tip edge 92. Another feature of the current disclosure is directed towards reducing the strength of the electric filed under the electron source 90.

Figure 27B:
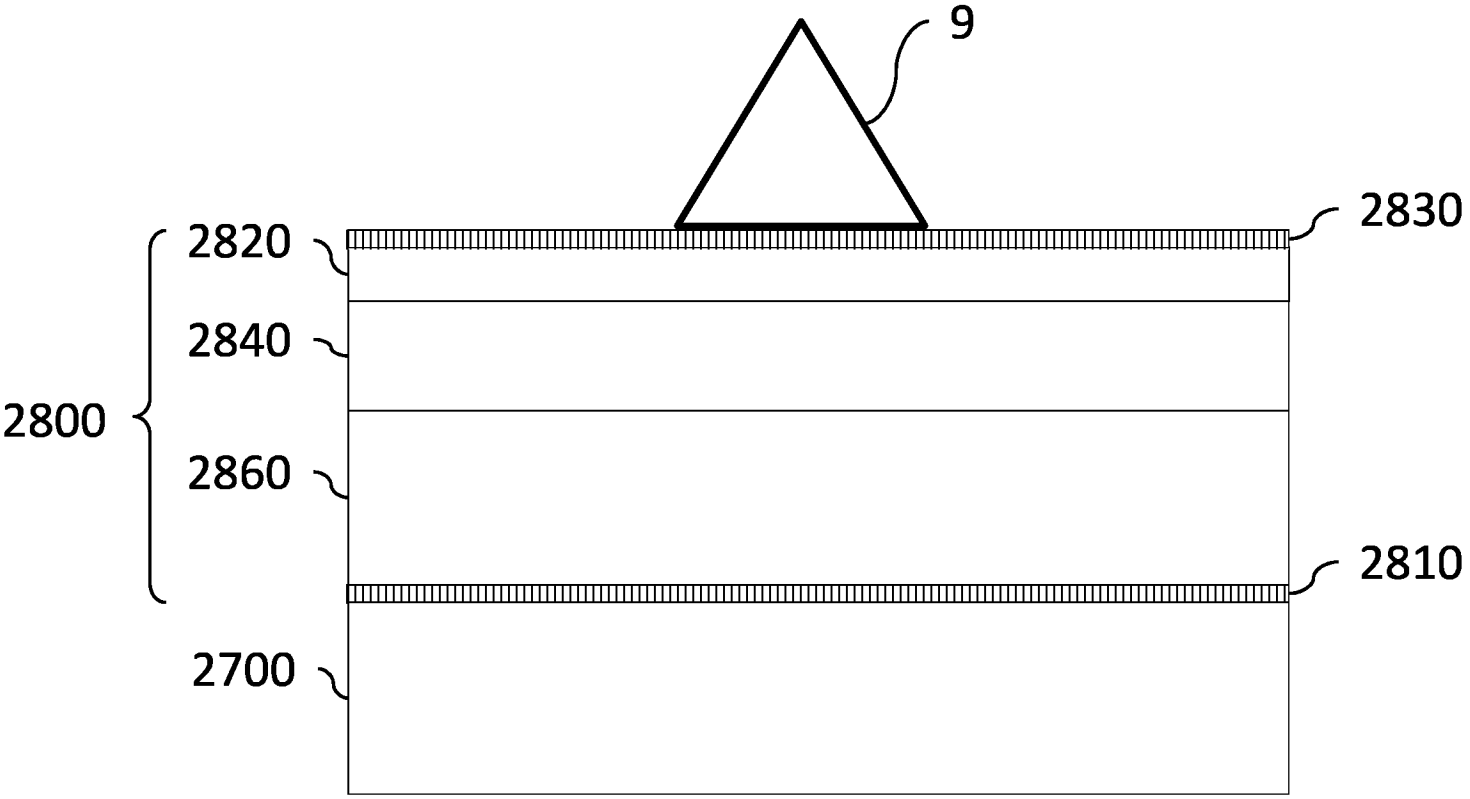
FIG. 27B schematically represents a section through a stratified resistive layer according to an embodiment of the electron emitting construct for use in various embodiments of image capture devices or x-ray emitting devices of the disclosure.

Referring now to FIG. 27B a schematic section through representation is shown of an embodiment of an electron emitting construct including a stratified resistive layer 2800 for use in an image capture device, or an x-ray emitting device of the disclosure. The electron emitting construct includes, amongst other elements, an electron source 9, a cathode layer 2700, a resistive stratum 2800, a first barrier stratum 2810 and a second barrier stratum 2830.

The stratified resistive layer 2800 includes a proximal resistor stratum 2820, closest to the electron source 9, a distal resistor stratum 2860 further from the electron source, and an intermediate resistor stratum 2840 sandwiched between said proximal resistor stratum 2820 and said distal resistor stratum 2860. The materials of each stratum may be selected so as to control resistivity of the resistive layer with depth. Accordingly, the proximal resistor stratum 2820 may be formed from a highly resistive material selected for its high characteristic resistivity, the distal resistor stratum 2860 may be formed from a lower resistive material selected for its low characteristic resistivity, and the intermediate resistor stratum may be formed from another resistive material having a characteristic resistivity intermediate between that of the highly resistive material and the lower resistive material.

Various materials may be used for the resistance layers such as, amongst others, silicon oxygen carbonitride (SiOCN), which may be used for the proximal resistor stratum, possibly to a depth of about ten nanometers of so. Where required, amorphose silicon carbonitride (a-SiCN) film may be used for the intermediate resistor stratum, say for a further 200 nanometers, and a silicon carbide (SiC) or silicon (Si) layer may be used for the distal resistor stratum. It is particularly noted that the distal resistor stratum may be constructed from a single crystal silicon carbide wafer perhaps 100 microns or so in thickness.

It is noted that, although a triple layered resistance structure is described above, other stratified resistance layers may alternatively be used as suit requirements, such as a double layer having only a proximal resistor stratum and a distal resistor stratum with no intermediate resistor stratum. Still other embodiments include materials having continuous resistance gradients with resistivity increasing with depth.

The barrier stratum 2810, 2830 may comprise layers of unreactive or inert material provided to prevent the materials of the resistive stratum 2800, such as silicon, silicon carbide, silicon carbonitride or the like, reacting with the metal of the cathode or the electron source during heating treatment in the cathode or during the assembly.

Accordingly, the first barrier stratum 2810 may consist of a layer of unreactive material which is interposed between the resistive material of the distal resistor stratum 2860 and the cathode 2870, and the second barrier stratum 2830 may consist of a layer of unreactive material which is interposed between the resistive material of the proximal resistor stratum 2820 and the electron source 9. Variously the unreactive material may be selected from materials such as carbon rich siliconcarbide, nitrogen rich silicon carbonitride, amorphous carbon and the like as well as combinations thereof as required.

In various embodiments, the unreactive material may be selected from carbon rich siliconcarbide compositions having various proportions of Silicon and carbon such as over 50% carbon, between 50% and 60% carbon, between 60% and 70% carbon, between 70% and 80% carbon, between 30% and 40% carbon, between 40% and 50% carbon, between 45% and 75% carbon or the like. It is particularly noted that carbon rich siliconcarbide ($Si_xC_y$) may be selected in which y is greater than x.

Alternatively or additionally, the unreactive material may be selected from nitrogen rich siliconcarbonitride compositions having various proportions of Silicon, carbon and nitrogen for example including over 25% nitrogen, between 25% and 35% nitrogen, between 35% and 45% nitrogen, between 45% and 55% nitrogen, above 50% nitrogen or the like. It is particularly noted that carbon rich siliconcarbonitride ($Si_xC_yN_z$) may be selected in which z is greater than y.

The scope of the disclosed embodiments may be defined by the appended claims and includes both combinations and sub combinations of the various features described hereinabove as well as variations and modifications thereof, which would occur to persons skilled in the art upon reading the foregoing description.

Technical and scientific terms used herein should have the same meaning as commonly understood by one of ordinary skill in the art to which the disclosure pertains. Nevertheless, it is expected that during the life of a patent maturing from this application many relevant systems and methods will be developed.

As used herein the term "about" refers to at least ±10%.

The terms "comprises", "comprising", "includes", "including", "having" and their conjugates mean "including but not limited to" and indicate that the components listed are included, but not generally to the exclusion of other components. Such terms encompass the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" may include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments or to exclude the incorporation of features from other embodiments.

The word "optionally" is used herein to mean "is provided in some embodiments and not provided in other embodiments". Any particular embodiment of the disclosure may include a plurality of "optional" features unless such features conflict.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween. It should be understood, therefore, that the description in range format is merely for convenience and brevity and should not be construed as an inflexible limitation on the scope of the disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6 as well as non-integral intermediate values. This applies regardless of the breadth of the range.

It is appreciated that certain features of the disclosure, which are, for clarity, described in the context of separate embodiments, may also be provided in combination in a single embodiment. Conversely, various features of the disclosure, which are, for brevity, described in the context of a single embodiment, may also be provided separately or in any suitable subcombination or as suitable in any other described embodiment of the disclosure. Certain features described in the context of various embodiments are not to be considered essential features of those embodiments, unless the embodiment is inoperative without those elements.

Although the disclosure has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present disclosure. To the extent that section headings are used, they should not be construed as necessarily limiting.

The invention claimed is:

1. An electron emitting construct operable to direct electrons to an electron receiving construct separated therefrom by at least one spacer situated such that an unobstructed inner gap is present between said electron receiving construct and said electron emitting construct, said electron emitting construct comprising:

a backplate;

a substrate;

a cathode;

a gate electrode;

a plurality of field emission type electron sources arranged in an array, said field emission type electron sources configured to emit an electron beam towards said electron receiving construct;

a stratified resistive layer situated between the array of field emission type electron sources and the cathode;

wherein said stratified resistive layer comprises at least a proximal resistor stratum closest to said field emission type electron sources, and a distal resistor stratum further from said field emission type electron sources, said proximal resistor stratum comprising a first resistive material having a first characteristic resistivity, and said distal resistor stratum comprising a second resistive material having a second characteristic resistivity, said first characteristic resistivity being greater than said second characteristic resistivity, and wherein at least one resistor stratum comprises at least one silicon carbide crystal.

2. The electron emitting construct of claim 1 wherein said stratified resistive layer further comprises at least one intermediate resistor stratum between said proximal resistor stratum and said distal resistor stratum, said at least one intermediate resistor stratum comprising at least a third resistive material having a characteristic resistivity intermediate between said first characteristic resistivity and said second characteristic resistivity.

3. The electron emitting construct of claim 2 wherein said intermediate resistor stratum comprises an amorphous silicon carbonitride film.

4. The electron emitting construct of claim 1 wherein said proximal resistor stratum comprises SiOCN.

5. The electron emitting construct of claim 1 wherein said proximal resistor stratum comprises a silicon carbide wafer.

6. The electron emitting construct of claim 1 wherein distal resistor stratum comprises a silicon carbide wafer.

7. The electron emitting construct of claim 1 wherein said distal resistor stratum comprises Si.

8. The electron emitting construct of claim 1, said stratified resistive layer comprising at least one resistive stratum comprising a resistive material, and at least one of a first barrier stratum interposed between said resistive material and said cathode or a second barrier stratum interposed between said resistive material and said field emission type electron sources.

9. The electron emitting construct of claim 8 wherein at least one of said first barrier stratum and said second barrier stratum comprises a material selected from an unreactive material selected from the group consisting of: carbon rich siliconcarbide, nitrogen rich silicon carbonitride, amorphous carbon and combinations thereof.

10. The electron emitting construct of claim 1 further comprising a gate electrode support structure is configured to support said gate electrode at a cathode-gate spacing such that a surface path between said cathode and said gate electrode is greater than said cathode-gate spacing.

11. The electron emitting construct of claim 10 wherein said gate electrode support structure comprises a stratified interlayer comprising at least one stratum of a first material and at least one stratum of a second material wherein said first material is more readily etched than said second material.

12. The electron emitting construct of claim 11, characterized by at least one limitation selected from:

said stratified interlayer comprising at least one stratum of a low density material and at least a one stratum of a high density material;

said stratified interlayer comprising at least one stratum of silicon dioxide;

said stratified interlayer comprising at least one stratum of high density silicon dioxide and at least one stratum of low density silicon dioxide;

said stratified interlayer comprising at least one stratum of silicon dioxide and at least one stratum of silicon oxynitride.

13. The electron emitting construct of claim 1 comprising a gate electrode support structure comprising a plurality of support columns arranged in an array having a regular column-spacing between said support columns wherein said column-spacing is greater than source-spacing between said electron sources.

14. The electron emitting construct of claim 13 wherein said support columns are configured such that the column-source spacing between at least one said support column and at least one neighboring electron source is greater than a source-spacing between said electron sources.

15. The electron emitting construct of claim 1 further comprising a plurality of first focus structures arranged in an array, each of said first focus structures comprising a first focus electrode, wherein the first focus structure surrounds a unit cell comprising a subset of said field emission type electron sources, said unit cell defining an emitter area.

16. The electron emitting construct of claim 15, further comprising an array of second focus structures comprising a second focus electrode.

17. An image capture device comprising the electron emitting construct of claim 1 and said electron receiving construct, wherein said electron receiving construct comprises a faceplate, an anode and an inward facing photoconductor and said plurality of field emission type electron sources are configured to direct said electron beam towards said photoconductor.

18. An x-ray emitting device comprising the electron emitting construct of claim 1 and said electron receiving construct, wherein said electron receiving construct comprises an x-ray target anode and said plurality of field emission type electron sources are configured to direct said electron beam towards said x-ray target.

19. An x-ray imaging device comprising:

an x-ray emitting device comprising a first electron emitting construct of claim 1 configured to direct a first electron beam towards said x-ray target; and an image capture device comprising a second electron emitting construct of claim 1 configured to direct a second electron beam towards an inward facing photoconductor.

20. An electron emitting construct operable to direct electrons to an electron receiving construct separated therefrom by at least one spacer situated such that an unobstructed inner gap is present between said electron receiving construct and said electron emitting construct, said electron emitting construct comprising:

a backplate;

a substrate;

a cathode;

a gate electrode;

a plurality of field emission type electron sources arranged in an array, said field emission type electron sources configured to emit an electron beam towards said electron receiving construct;

a stratified resistive layer situated between the array of field emission type electron sources and the cathode;

wherein said stratified resistive layer comprises at least a proximal resistor stratum closest to said field emission type electron sources, and a distal resistor stratum further from said field emission type electron sources, said proximal resistor stratum comprising a first resistive material having a first characteristic resistivity, and said distal resistor stratum comprising a second resistive material having a second characteristic resistivity, said first characteristic resistivity being greater than said second characteristic resistivity, said stratified resistive layer further comprises at least one intermediate resistor stratum between said proximal resistor stratum and said distal resistor stratum, said at least one intermediate resistor stratum comprising at least a third resistive material having a characteristic resistivity intermediate between said first characteristic resistivity and said second characteristic resistivity.

* * * * *